US011498731B2

(12) United States Patent
Lebon

(10) Patent No.: US 11,498,731 B2
(45) Date of Patent: Nov. 15, 2022

(54) TAMPER-EVIDENT CLOSURE, CONTAINER WITH SUCH CLOSURE AND ITS USE

(71) Applicant: Clariant Healthcare Packaging (France) SAS, Choisy le Roi (FR)

(72) Inventor: Jacquy Lebon, Challands (FR)

(73) Assignee: AIRNOV, INC., Wilmington, DE (US)

( * ) Notice: Subject to any disclaimer, the term of this patent is extended or adjusted under 35 U.S.C. 154(b) by 219 days.

(21) Appl. No.: 16/311,485

(22) PCT Filed: Jun. 22, 2017

(86) PCT No.: PCT/EP2017/065411
§ 371 (c)(1),
(2) Date: Dec. 19, 2018

(87) PCT Pub. No.: WO2017/220729
PCT Pub. Date: Dec. 28, 2017

(65) Prior Publication Data

US 2019/0344938 A1 Nov. 14, 2019

(30) Foreign Application Priority Data

Jun. 22, 2016 (EP) ..... 16305755

(51) Int. Cl.
*B65D 50/04* (2006.01)
*B65D 50/00* (2006.01)
(Continued)

(52) U.S. Cl.
CPC ..... *B65D 50/041* (2013.01); *B65D 41/0414* (2013.01); *B65D 51/244* (2013.01);
(Continued)

(58) Field of Classification Search
CPC ..... B65D 41/0414; B65D 51/244; B65D 55/024; B65D 2401/15; B65D 2251/0015;
(Continued)

(56) References Cited

U.S. PATENT DOCUMENTS 2,867,342 A * 1/1959 Baars ..... B65D 50/048 215/220
3,472,410 A 10/1969 Turner
(Continued)

FOREIGN PATENT DOCUMENTS

AU 7414787 A 7/1988
CN 201419846 Y 3/2010
(Continued)

OTHER PUBLICATIONS

International Search Report with Written Opinion of the International Searching Authority, dated Sep. 14, 2017, with respect to International Application No. PCT/EP2017/065411.
(Continued)

*Primary Examiner* — Gideon R Weinerth
(74) *Attorney, Agent, or Firm* — Scott R. Cox

(57) ABSTRACT

A tamper-evident closure for a container with an outer screw thread opening, including an outer cap with a first sidewall and a first top wall and an inner cap with a second sidewall and a second top wall. The inner cap is coaxially nested within the outer cap and has an inner thread. The outer and inner cap have cooperating engagement mechanisms arranged and shaped so when opening the closure for the first time, the inner cap is rotated by the outer cap. The first top wall has a tamper-evident member which is connected to a surrounding region of the first top wall by a frangible component. A protruding element, arranged for breaking the frangible component, is arranged at the first top wall facing the second top wall and/or the second top wall facing the first top wall so as to face the tamper-evident member.

8 Claims, 17 Drawing Sheets

(51) Int. Cl.
*B65D 55/02* (2006.01)
*B65D 41/04* (2006.01)
*B65D 51/24* (2006.01)

(52) U.S. Cl.
CPC ..... *B65D 55/024* (2013.01); *B65D 2251/009* (2013.01); *B65D 2251/0015* (2013.01); *B65D 2251/04* (2013.01); *B65D 2401/15* (2020.05)

(58) Field of Classification Search
CPC ..... B65D 2251/009; B65D 2251/04; B65D 17/404; B65D 41/3409; B65D 50/041; B65D 51/18; B65D 55/026; B65D 47/0809
USPC ..... 215/219, 220, 230, 203, 206, 251, 217, 215/250, 256, 223; 206/807; 220/255
See application file for complete search history.

(56) References Cited

U.S. PATENT DOCUMENTS 3,472,420 A 10/1969 Hiatt
3,857,505 A 12/1974 Mumford et al.
3,896,335 A * 7/1975 Bogert ..... B65D 50/041 215/219
3,918,602 A * 11/1975 McIntosh ..... B65D 50/041 215/219
3,942,436 A 3/1976 Lupkas
4,011,960 A * 3/1977 Mauvernay ..... B65D 50/041 215/220
4,138,029 A * 2/1979 Mahoney ..... B65D 51/145 206/459.1
4,281,771 A 8/1981 Siegel
4,371,088 A 2/1983 Gach
4,440,306 A * 4/1984 Van Buskirk ..... B65D 55/02 215/230
4,501,370 A * 2/1985 Kelley ..... B65D 50/041 116/308
4,527,701 A * 7/1985 Schaubeck ..... B65D 50/041 215/220
4,588,098 A * 5/1986 Uzdy ..... B65D 55/026 215/250
4,632,264 A * 12/1986 Evans ..... B65D 50/041 215/220
4,641,759 A * 2/1987 Kelley ..... B65D 50/041 116/308
4,669,620 A 6/1987 Coifman
4,673,095 A * 6/1987 Puresevic ..... B65D 50/041 215/220
4,723,673 A * 2/1988 Tartaglia ..... B65D 55/026 215/230
4,801,028 A * 1/1989 Puresevic ..... B65D 50/041 215/203
5,005,718 A 4/1991 Buono
5,054,633 A 10/1991 Reijenga
5,148,931 A 9/1992 Minh
5,176,269 A * 1/1993 Herman ..... B65D 41/0492 215/228
5,265,744 A * 11/1993 Duty ..... B65D 50/041 116/200
5,344,035 A * 9/1994 Manera ..... B65D 50/068 215/206
5,381,917 A * 1/1995 Santagiuliana ..... B65D 50/041 220/220
5,520,296 A 5/1996 Freed
5,605,240 A 2/1997 Guglielmini
5,667,085 A 9/1997 Ogden et al.
5,762,215 A 6/1998 Ogden
5,960,972 A * 10/1999 Larguia, Sr. ..... B65D 41/18 215/322
6,029,834 A * 2/2000 Sanner ..... B65D 50/041 215/220
8,302,792 B2 11/2012 Logel et al.
8,499,949 B2 * 8/2013 Lahusen ..... B65D 55/026 215/230
9,586,738 B2 3/2017 Herrbach et al.
9,650,184 B2 5/2017 Fily et al.
10,625,913 B2 * 4/2020 Acevedo ..... B65D 55/026
2005/0115968 A1 6/2005 Myhre
2005/0150857 A1 * 7/2005 Brozell ..... B65D 50/041 215/220
2006/0108381 A1 5/2006 Hoepner et al.
2007/0084735 A1 4/2007 Lancesseur et al.
2007/0108210 A1 5/2007 Alvares et al.
2007/0272646 A1 11/2007 Lancesseur et al.
2008/0251573 A1 10/2008 Nobilet et al.
2010/0237072 A1 * 9/2010 Ahn ..... B65D 50/041 220/254.8
2010/0288765 A1 * 11/2010 Herrbach ..... B65D 51/30 220/212
2011/0062176 A1 3/2011 Lourenco et al.
2015/0186770 A1 * 7/2015 Arai ..... B65D 41/3423 235/492
2015/0197366 A1 * 7/2015 Chapin ..... B65D 51/22 220/254.1
2017/0312174 A1 * 11/2017 Azuma ..... A61F 9/0008
2018/0118423 A1 * 5/2018 Bois ..... B65D 51/30
2018/0346211 A1 * 12/2018 Painchaud ..... B65D 47/2081
2020/0385182 A1 * 12/2020 Lebon ..... B65D 41/0414

FOREIGN PATENT DOCUMENTS

CN 204096281 U 1/2015
DE 7441556 U 6/1976
EP 0519627 A2 12/1992
EP 0544381 A2 6/1993
GB 1483678 8/1977
GB 2141697 A 1/1985
GB 2167050 A 5/1986
JP 2011219110 A 4/2011
WO WO 8500344 A1 1/1985
WO WO8902858 A 4/1989
WO WO 9418087 A1 8/1994
WO WO9928205 A1 6/1999
WO WO2005007526 A1 1/2005
WO WO2006026836 A1 3/2006
WO WO2009138128 A1 11/2009
WO WO2011039400 A1 4/2011

OTHER PUBLICATIONS

International Preliminary Report on Patentability of the International Searching Authority, dated Dec. 25, 2018, with respect to International Application No. PCT/EP2017/065411.
European Search Report of The Hague, dated Sep. 7, 2017, in corresponding parallel EP application No. 17 177 381.5, cited only for references disclosed therein.
Official Communication of the EPO, dated Nov. 20, 2018, in corresponding parallel EP application No. 17 177 381.5—PCT/EP2018/0066754.
International Search Report with Written Opinion of the International Searching Authority, dated Nov. 20, 2018, with respect to International Application No. PCT/EP2018/0066754 claiming priority from EP 17 177 381.5.

* cited by examiner

TAMPER-EVIDENT CLOSURE, CONTAINER WITH SUCH CLOSURE AND ITS USE

FIELD OF THE INVENTION

The invention relates to a tamper-evident closure. Further, the invention relates to a container with such closure and its specific use.

PRIOR ART

Tamper-evident closures are often used for containers holding pharmaceutical substances.

A safety feature of such closures which sometimes has to be combined with child resistant characteristics is an indication whether the closure has already been opened before. For this purpose, tamper-evident indicators are commonly used. For screw caps, the most common tamper-evident indicator is a ring surrounding the lower end of the cap which is connected to the cap by means of a plurality of frangible bridges. When opening the cap for the first time, the frangible bridges are broken disconnecting the tamper-evident ring from the cap. However, such solution requires an adapted container with protruding parts or a peripheral groove close to the threaded neck.

Another solution for providing the tamper-evident function consists in welding a foil on the upper surface of the opening of the container. When using such solution, it is no longer possible to integrate a desiccant chamber on the closure which projects into the interior of the container.

DISCLOSURE OF THE INVENTION

It is the object of the invention to provide a closure for a container which combines several functionalities. On one hand, it should be tamper-evident. Further, it should be possible to use the closure in such a way that an active material, like a desiccant can be integrated. Finally, it should be possible to add the additional functionality of being child-resistant.

This object is solved by a tamper-evident closure of the features of claim 1, a container with such closure and its special use. Preferred embodiments follow from the dependent claims.

According to the invention, a tamper-evident closure for a container with an outer screw thread opening comprises an outer cap with a first side wall and a first top wall, and an inner cap with a second side wall and a second top wall. The inner cap is coaxially nested within the outer cap and provided with an inner thread to screw the inner cap onto the container. The outer cap and inner cap are provided with cooperating engagement means (first engagement means) which are arranged and shaped such that when opening the closure at least for the first time, the inner cap is rotated by the outer cap upon application on the outer cap of an axial force plus a turning mechanical torque in a first rotational direction. A part of the first top wall is a tamper-evident member which is connected to a surrounding region of the first top wall by a frangible means, and a protruding element is arranged at the first top wall facing the second top wall and/or the second top wall facing the first top wall so as to face the tamper-evident member. In that the protruding element faces the tamper-evident member, the protruding element may be used for breaking the frangible means, particularly by an axial movement of the outer cap relative to the inner cap. Alternatively or in addition thereto, the protruding element may be engaged with the opening formed when the tamper-evident member is removed from the first top wall, thereby serving as the engagement means and allowing for a rotation of the inner cap by the outer when opening the closure. According to a particular embodiment, the protruding element is arranged at least for breaking the frangible means.

The provision of an identification means further supports the customer to become aware that the tamper-evident member has been removed. Such identification means could be, for example, the provision of a protruding element with a different color which serves as a warning signal. Another possible identification means are frangible means which break such that a part of them remain connected to the first top wall and can be easily seen. Another possible identification means are indications provided on the top wall of the tamper-evident member and the surrounding region of the first top wall which supplement each other before the first opening and do no longer supplement each other once the tamper-evident member has been removed. Preferably, at least two indications are provided on the surrounding region of the first top wall. Finally, the protruding element can be provided with a warning symbol and/or text providing the information that the container has been tampered. All the above-described options for an identification means can be combined with each other in any possible ways.

Advantageously, the first top wall and/or the second top wall comprises an indication, more preferably at least two indications, that reveal once the tamper-evident member is removed such that, when the tamper-evident member is no more present, it becomes evident that the closure is no more tamper proof.

Preferably, the indication is present on the surrounding region and becomes visible once the tamper-evident member is removed such that, it becomes evident that a part of the first top wall is missing. For example, the indication can be present both on the outwardly facing surface of the tamper-evident member and the outwardly facing surface of the surrounding region, and supplement in such a way that, once the tamper-evident member is no more present, it becomes evident that a part of the top wall is missing and that the closure is no more tamper proof. In another example, the indication can be a protruding part of the surrounding region, wherein the protruding part is connected to a frangible means and remains once the tamper-evident member is removed. In this manner, it becomes visible that a part of the first top wall has been removed and that the container is no more tamper proof. Preferably, the remaining part of the surrounding region/frangible means protrudes at least 0.5 mm out of the surrounding region and into the opening left once the tamper-evident member has been removed.

According to a preferred embodiment of the invention, the child-resistant and tamper-evident closure further comprises at least one elastic means which is provided between the inner cap and the outer cap, particularly for urging the outer cap away from the inner cap in the axial direction. To put it differently, such elastic means has the function to axially move back the outer cap away from the inner cap once the axial force on the outer cap is removed. In order to open the closure, a complex movement is required starting from the pushing down of the outer cap followed by the rotation of the outer cap while maintaining the force pushing down the outer cap. Thus, the at least one elastic means further contributes to the child resistance of the closure. Further, an inadvertent breaking of the tamper-evident member during shipping and storage can be avoided because the tamper-evident member is urged away from the protruding element.

The at least one elastic means can be a shape-memory resilient element, which is preferably integrally moulded with the outer cap or with the inner cap, preferably with the outer cap. Alternatively, it can be joined to the first or second top wall by bonding or over-moulding. In a particular embodiment, the elastic means can be provided on the protruding part of the inner cap. The protruding part on the inner cap can be provided with at least one blade which deflects when a downward pressure is applied and returns back to its original position by shape memory.

According to a preferred embodiment of the invention, the tamper-evident closure further comprises a child-resistant means, wherein the child-resistant means comprises at least one elastic means which is provided between the outer cap and the inner cap, preferably for biasing the outer cap axially away from the inner cap. Therefore, each time the closure is opened, the user will have to push the outer cap towards the inner cap against the biasing force of the elastic means before the inner cap can be rotated together with the outer cap in the first rotational direction. Such complex movement and the application of a sufficient force to overcome the biasing force of the elastic means provides for a sufficient child-resistance.

In order to open such closure, a complex movement is required. The outer cap has to be pushed down relative to the inner cap before it is possible to unscrew the closure from the container. Such complex movement is child-proof. Further a tamper-evident member forms part of the first top wall which is the top wall of the outer cap. The protruding element arranged at the first top wall facing the second top wall and/or the second top wall facing the first top wall is sized such that the frangible means connecting the tamper-evident member to the surrounding region of the first top wall will be broken upon an axial movement of the outer cap towards the inner cap which is sufficient to bring the cooperating engagement means into an operational position relative to each other. In other words, in order to rotate the inner cap together with the outer cap when unscrewing the closure from a container, the outer cap must be pushed down towards the inner cap over an axial distance which exceeds the axial distance which is required to break the frangible means when first opening the closure.

More particularly, if the tamper-evident member is connected to the surrounding region of the first top wall by frangible means cooperation of engagement means for rotating the inner cap by the outer cap can be prevented. Accordingly, it is impossible to rotate the inner cap without breaking the frangible means.

According to an alternative preferred embodiment of the invention, the tamper-evident closure further comprises a blocking means for fixing the relative axial positions of the outer cap and the inner cap once the tamper-evident member has been removed by pushing the outer cap towards the inner cap. In other words, once the tamper-evident member has been removed before the first opening of the closure, the outer cap is fixed in its relative position with respect to the inner cap so that during the further use of the closure, it is no longer required to carry out a complex movement of pushing down the outer cap before opening the container by means of a rotation of the outer cap in the first rotational direction. Both the repeated opening and closing of the container is achieved by simple rotation of the tamper-evident closure.

The inventive closure is suitable for all types of screw-necked bottles or containers. There are no specific requirements for the shape of the neck of the bottle or container except for the provision of an outer thread.

Further, the inventive closure makes it easily possible to provide a desiccating element at the inner side of the closure, i.e. the surface of the second top wall of the inner cap which faces the interior of the container when the inventive closure is screwed onto a container.

The tamper-evident indication is very easy to notice because it is arranged at the top of the closure. Preferably, the tamper-evident member should have a diameter which is as large as possible. Preferably, the major diameter of the tamper-evident member is at least 60% of the diameter of the outer cap. Alternatively or in addition, the radial width of the surrounding region is at least 5 mm. When opening the closure, the outer cap has to be pushed towards the inner cap. A user who pushes down the outer cap will, under normal circumstances, look onto the top side of the closure so that the tamper-evident member is in a position where it cannot be missed that the closure has been opened before.

Finally, the provision of the tamper-evident member forming part of the first top surface is easier to manufacture. There is no need for a breakable ring which determines, in part, the moulding cycle time which is an important factor for such mass products. Furthermore, breakable rings can be easily broken or damaged when assembling or storing the caps before they will be screwed onto the container.

According to a preferred embodiment of the invention, the closure further comprises second cooperating engagement means, the second engagement means being arranged and shaped such that when closing the closure, the inner cap is rotated by the outer cap upon application of a turning mechanical torque in a second rotational direction on the outer cap. When closing the closure onto the container, no childproof function is required. The second cooperating engagement means makes it possible to easily close the closure after its use because the inner cap is rotated by the outer cap upon application of a turning mechanical torque only and without the need for an axial relative displacement between the outer cap and the inner cap.

According to a first preferred variant, the second cooperating engagement means are arranged between the first sidewall and the second sidewall. According to a second preferred variant, the second cooperating engagement means are arranged between the first top wall and the second top wall and comprise the at least one elastic means. The second variant has the advantage that the overall diameter of the closure can be kept small because the inner diameter of the sidewall of the outer cap can be dimensioned such that it snugly fits over the outer diameter of the sidewall of the inner cap. No engagement means have to be arranged between the sidewalls of the inner cap and the outer cap. A further advantage of this embodiment is that the second cooperating engagement means comprise the at least one elastic means. Thus, the elastic means can have a double function in that they actually urge the outer cap away from the inner cap and, at the same time, form part of the second cooperating engagement means.

According to a preferred embodiment, the second cooperating engagement means arranged between the first top wall and the second top wall comprise a plurality of elastic members in the shape of inclined strips and a plurality of wedge-shaped elements, wherein, when rotating the outer cap in the second rotational direction, the elastic members come into a locking arrangement with the wedge-shaped elements so that the inner cap rotates with the outer cap in the second rotational direction. The wedge-shaped elements have the further advantage that, if the outer cap is rotated in the first rotational direction but without pushing down the outer cap relative to the inner cap, the elastic members slide over the wedge-shaped elements and will generate an audible indication. For the user, the audible indication signals that the outer cap has not been pushed down sufficiently to open the closure. At the same time, the audible indication provides for an additional safety because children who might try to open the closure might be heard by adults who can intervene, and will usually be fascinated by the generated sound so that small children will not have any motivation to operate the container in a different way than that which produces the sound by means of the ratcheting function of the second cooperating engagement means.

Preferably, the elastic members cooperating with the wedge-shaped elements comprise a basis starting at which the elastic members are attached to the first or second top wall, wherein the elastic members extend at the basis generally perpendicularly to the first or second top wall, an inclined portion ending at a second end, a curved transitional portion between the basis and the inclined portion, and, preferably, a reinforcing rib between the first or second top wall close to the basis and the inclined portion. Such elastic member has an increased strength and robustness. Strip-like elastic means which are inclined relative to the wall to which they are attached and which do not have a basis at which they start perpendicularly from the wall to which they are attached usually have a lower stiffness and are more prone to turn over or twist/wring if they are bent an increased number of times. In this case, the closure becomes inoperable because the inner cap can no longer be driven by turning the outer cap when opening. Further, the reinforcing rib acts as a fortification member which further strengthens the elastic members and stabilizes the angular orientation of the strip-like member. It has been found that such a shape does not only provide for an increased strength but also generates a relatively loud clicking noise if a plurality of such elastic members slide over the inclined surfaces of the wedge-shaped members. However, the intensity of the clicking noise can also be increased by other factors like the stiffness of the plastic material and the width and thickness of the elastic means which lead to a higher spring back elasticity of the elastic members. Preferably, the reinforcing ribs follow the curved shape of the elastic members and extend in a curved circumferential direction, i.e. parallel to the sidewall.

Preferably, the first engagement means are arranged between the first top wall and second top wall, respectively. Such arrangement places the engagement means close to the position where a user applies the pushing force for axially displacing the outer cap. As a result, a failsafe operation can be achieved even when using a material for the caps which has a higher resilience or considering fatigue of the material.

Preferably, the tamper-evident member and/or the surrounding region is provided with an opening which is sized to allow the passage of the tip of a finger. Such opening allows the user to conveniently remove the tamper-evident member. More preferably, the opening is provided on the tamper-evident member so that a user can use the tip of the finger inserted into the opening to apply an upwards direction pressure on the tamper-evident member. Alternatively the tamper-evident member is provided with a seizure member to grip the tamper-evident member for removing. For example a tongue, ring or latch, may be provided to grip the tamper-evident member for removing. If the protruding element is not used to separate the tamper-evident member from the surrounding region of the outer cap, the opening or the tongue/latch may also be used for breaking the frangible means. Furthermore, such opening or tongue/latch facilitates the removal of the tamper-evident member before the closure is first opened. In such a way, specific closures can be designed such that the force required for pushing down the outer cap towards the inner cap can be minimized. Such specific closures can be advantageous e.g. for closing a container for medication for arthritic persons.

According to a preferred embodiment, the frangible means comprises frangible bridges between the tamper-evident element and the surrounding region of the first top wall. As an alternative preferred embodiment, the frangible means comprises a continuous or discontinuous weakness of the material between the tamper-evident element and the surrounding region of the first top wall. Both options generate a well-defined strength of the frangible means so that the pushing force required for the first opening of the closure can be adjusted.

According to a preferred embodiment, the first side wall and the second side wall comprise cooperating locking elements to prevent a removal of the outer cap from the inner cap once assembled, the cooperating locking elements preferably being a continuous or discontinuous bead on the inner side of the first side wall of the outer cap and a continuous or discontinuous rib on the outer side of the second side wall of the inner cap. Alternatively, the cooperating locking elements may be formed by the combination of a protrusion on the outer/inner side of the second/first side wall of the inner/outer cap engaging with a corresponding groove on the inner/outer side of the first/second side wall of the outer/inner cap, respectively.

According to a preferred embodiment of the invention, the tamper-evident closure further comprises a means for holding an active material, the active material preferably being a desiccant or oxygen scavenger. The active material can be any substance or a mixture of individual substances able to trap and/or release a gas which can be moisture, oxygen or an odor just to give some examples. Examples of desiccating agents are silica gel, molecular sieve, clay or other zeolites or a mixture thereof. Examples of oxygen scavengers are iron-based oxygen scavengers, organic oxygen scavengers, enzymatic scavengers, unsaturated polymers or a mixture thereof.

Preferably, the means for holding an active material is a chamber. The chamber can be integrally formed with the inner cap.

Alternatively, the means for holding an active material is a receptacle for the attachment of a canister provided on a side of the second top wall opposite to that facing the first top wall. Thus, the canister is attached on that surface of the second top wall which, when the closure is mounted on a container, faces the interior of the container.

According to a preferred embodiment of the invention, the inner cap is provided with a sealing member which, when the closure is screwed onto a container, is arranged to provide a hermetic (moisture tight) seal between the inner cap and the opening of the container. The sealing member can be a gasket arranged to provide a hermetic seal between the inner cap and the upper surface of the sidewall of the container or any other kind of seal that can be integrally molded or assembled. Preferably, the sealing member is a ring-shaped inner sealing skirt which, when the closure is screwed onto a container, is arranged to provide a hermetic seal between the inner cap and the inner circumference of the opening of the container. Preferably, the sealing skirt comprises a slanted sealing surface, more particularly an inwardly slanted external sealing surface. The sealing skirt is preferably provided with an annular protrusion at or close to its distal end. In such a way, the closure prevents the ingress of moisture into the container once the closure has been firmly screwed onto the container. This increases the shelf-life of the content of the container (filled with moisture-sensitive items).

The tamper-evident member can be arranged off-center relative to the first top wall. Such arrangement still makes it possible to provide a clear indication that the closure has been opened before, while leaving sufficient space on the first top wall for other purposes, like the provision of a label.

According to a preferred embodiment, the protruding element is arranged at the second top wall facing the first top wall for breaking the frangible means, and the tamper-evident member and the protruding element have respective shapes and positions to provide a form-fit connection between the surrounding region of the first top wall and the protruding element. In such a way, the protruding element can have a double function in that, when first opening the closure, it breaks the frangible means, and further serves as a drive element to transmit the rotational torque applied to the outer cap to the inner cap. Accordingly, the protruding element and an opening formed by removing the tamper-evident member may be engaged thereby forming the first engagement means. This approach is particularly beneficial in combination with the use of the earlier described elastic member. In this case, the form-fit connection (engagement) between the protruding element and the opening formed by removing the tamper-evident member is only achieved upon application of an axial-force onto the outer cap, whereby the outer cap is moved towards the inner cap against the elastic force of the elastic member. The form-fit connection can be operable by means of a specific geometry not being fully circular and is, in this embodiment, operable in a rotational direction of the protrusion. Alternatively or in addition, the tamper-evident member can be provided in an off-center position in the first top wall as described above which provides for a form-fit operable in the first rotational direction. The latter may provide for the double function described above, even if the geometry of the protruding element is fully circular. In other words, any geometry can be selected to provide the form-fit connection, as long as the tamper-evident member does either not have a circular shape or is not provided in alignment with the center of rotation of the outer cap.

According to another aspect, the side edges of the protruding element or the inner edge of an opening formed when they tamper-evident member is removed may be provided with one or more beveled edge portions and one or more straight edge portions. In particular, the beveled edge portions have a slanted surface slanted relative to the axial direction. The straight edge portions are substantially parallel to the axial direction. Upon rotation of the outer cap in the first rotational direction, a corner edge of the opening or the protruding element slides along the beveled edge portions without transferring the rotational force from the outer cap to the inner cap. The corner edge is sufficiently pressed against the beveled edge portions only upon application of an axial force on the outer cap, whereby the mechanical torque is transferred from the outer cap via the engaged corner edge and beveled edge portions to the inner cap. Accordingly, the inner cap is rotated together with the outer cap by friction forces between the corner edge and the beveled edge portions. In this embodiment, the corner edge and the beveled edge portions being engaged by frictional forces form the first engagement means.

The shape of the protruding member can additionally increase the safety against the opening of the closure by a child. Shapes like a cross or a clover need to be correctly aligned by bringing the outer cap into a correct position relative to the inner cap. In such a way, the required operation for opening the closure becomes even more complex: in a first step, the outer cap has two be rotated relative to the inner cap in order to match the protruding element with the shape of the tamper-evident member. In a second step, the outer cap has to be pushed in an axial direction toward the inner cap. In a third step, the outer cap is rotated and will, by means of the form fit connection, also rotate the inner cap to unscrew the inner cap from the container. Especially the first step might not be possible for a young child even after the child could observe an adult when opening the closure.

A complex shape of the protruding member matching the shape of the tamper-evident member can also be used to represent a symbol or logo.

The protruding element is generally not visible before the first use of the closure. Yet, under certain circumstances, particularly if the outer shape of the protruding element and the tamper-evident member are not fully circular or if the tamper-evident member is arranged off-center relative to the first top wall, it may be required to align the protruding element with the tamper-evident member. This may be perceived difficult if the protruding element and therefore its positional relationship to the tamper-evident member is not visible. This problem may either be overcome by removing the tamper-evident member manually as already disclosed above and only afterwards align the opening formed by removing the tamper-evident member and the protruding element.

Alternatively, however, a landmark or point of reference can be provided to indicate to the user the position of the outer cap relative to the inner cap at which the protruding element and the tamper-evident member are properly aligned to each other. This landmark or point of reference can be visual. For example a window may be provided in the outer cap, such as in the first top wall or in the first side wall. The window can be aligned with a mark provided on the second top wall or the second side wall of the inner cap. In addition or alternatively, the landmark or point of reference can be sensitive and/or audible. As a mere example, a combination of a protrusion and a notch may be provided, which in an aligned position of the outer cap and the inner cap, contact each other or are engaged. The protrusion may be provided at one of the outer cap and the inner cap and the notch may be provided at the other of the inner cap and the outer cap, respectively. Upon a contact (abutment) or engagement, the user receives a sensible (feels a click or resistance) or audible (hears a click) feedback, that the outer cap and the inner cap are now perfectly aligned with respect to the protruding element and the tamper-evident member. According to a preferred embodiment, the landmark or point of reference provided on the outer cap is positioned on the tamper-evident member. Accordingly, once the tamper-evident member is removed, also the landmark or point of reference is removed. In another embodiment, the outer cap can be made of a transparent plastic material which makes it easier for the user to align the shapes and positions of the inner cap and the outer cap.

According to a preferred embodiment of the invention, the protruding element is arranged at the second top wall facing the first top wall for breaking the frangible means and the protruding element is at least partially of a different color than the first top wall. After the first use, when the tamper-evident member has been removed from the first top wall, the user receives an additional visible indication of the prior opening. The different color can also be used for written information like the inscription “opened”. As an alternative, it is also possible to provide the tamper-evident member of a color which is different to that of the remaining part of the first top wall of the outer cap. In such a way, the optical appearance also changes after removal of the tamper-evident member. In this case, the outer cap with its tamper-evident member can be manufactured by bi-injection moulding (two component injection moulding). Yet, a different color in a portion of the inner cap and/or the outer cap can also be obtained by a screen printing (serigraphy), hot image transfer (hot stamping), pad printing (tampography) or hot stamping, etc.

Optionally, the protruding element can comprise written information or symbolics/imagery which may be obtained by using an engraved mould or one of the other possibilities mentioned above with respect to the optical appearance.

Preferably, the closure is made of a plastic material, preferably a polyolefin-based polymer.

The inventive container has the closure as described above fixedly screwed onto an outer screw thread of the container and closing same.

The inventive use of such container is for containing moisture-sensitive items, especially tablets and capsules containing a medical composition, neutraceuticals, herbalism or diagnostic products such as for example test strips.

BRIEF DESCRIPTION OF THE DRAWINGS

In the following, specific embodiments of the invention will be described with reference to the accompanying drawings.

DESCRIPTION OF PREFERRED EMBODIMENTS

Figure 1:
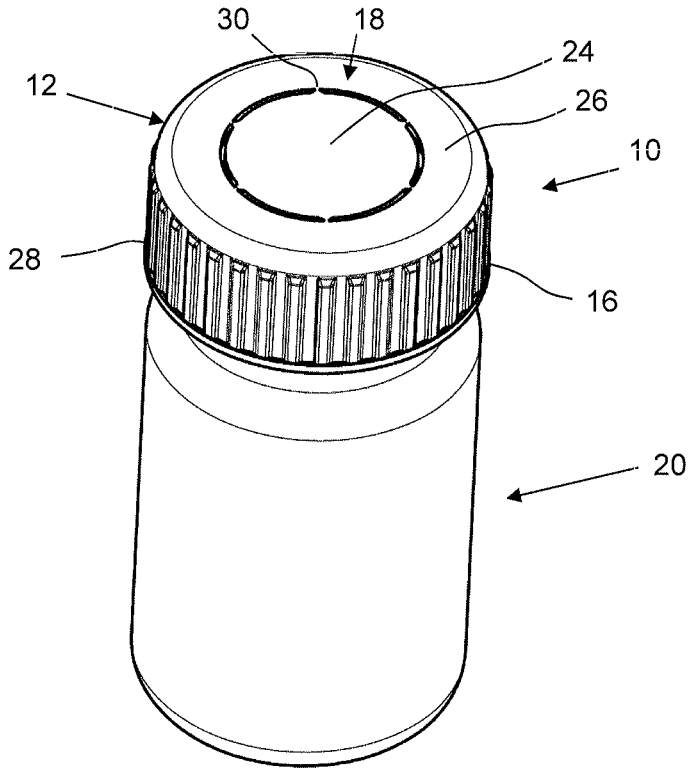
FIG. 1 schematically shows a container with a closure according to the invention.

In the following, some preferred embodiments of the invention will be described. Throughout the drawings, the same elements will be denoted by the same reference numerals.

Figure 3:
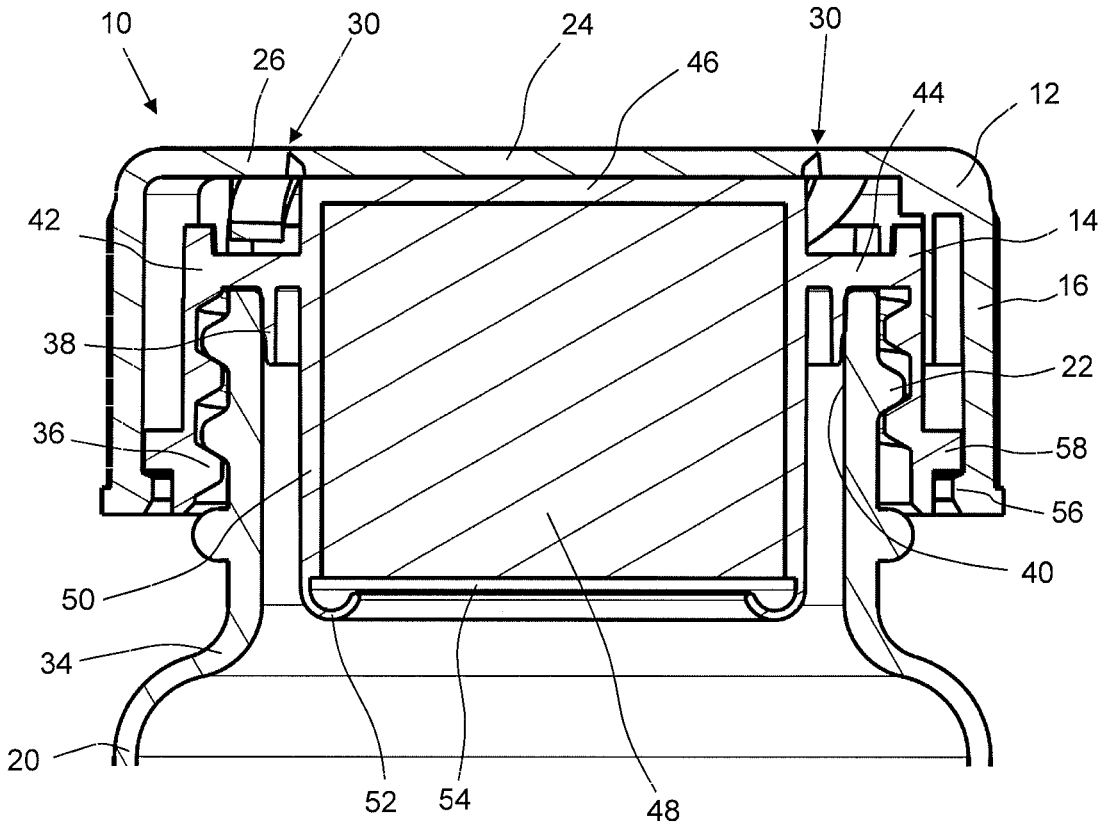
FIG. 3 is a cross-sectional view of a part of an example container with a closure according to a further embodiment of the invention.

FIG. 1 schematically shows a closure 10 according to the invention which is screwed onto a container 20 which, as will be shown in FIG. 3, is provided with an outer thread 22. The shape of the container 20 only serves as an example. The container 20 can have any shape as long as it is provided with an opening surrounded by an outer thread 22 which can be used to screw on the closure 10. In the example according to FIG. 1, the container is provided with a neck portion. However, it is also possible to provide the container in the shape of a bottle with a relatively narrow neck or in the shape of a straight cylinder. Likewise, it is possible to provide non-rotational geometries for the container as long as it is provided with an annular outer thread.

The closure 10 consists of two caps which are nested into each other. In FIG. 1, only the outer cap 12 can be seen. The outer cap 12 consists of a first sidewall 16 and a first top wall 18. The first sidewall 16 can be provided with suitable means to increase the grip for a user. In the example according to FIG. 1 a plurality of ribs 28 extending in an axial direction are provided on the first sidewall 16.

Figure 5A:
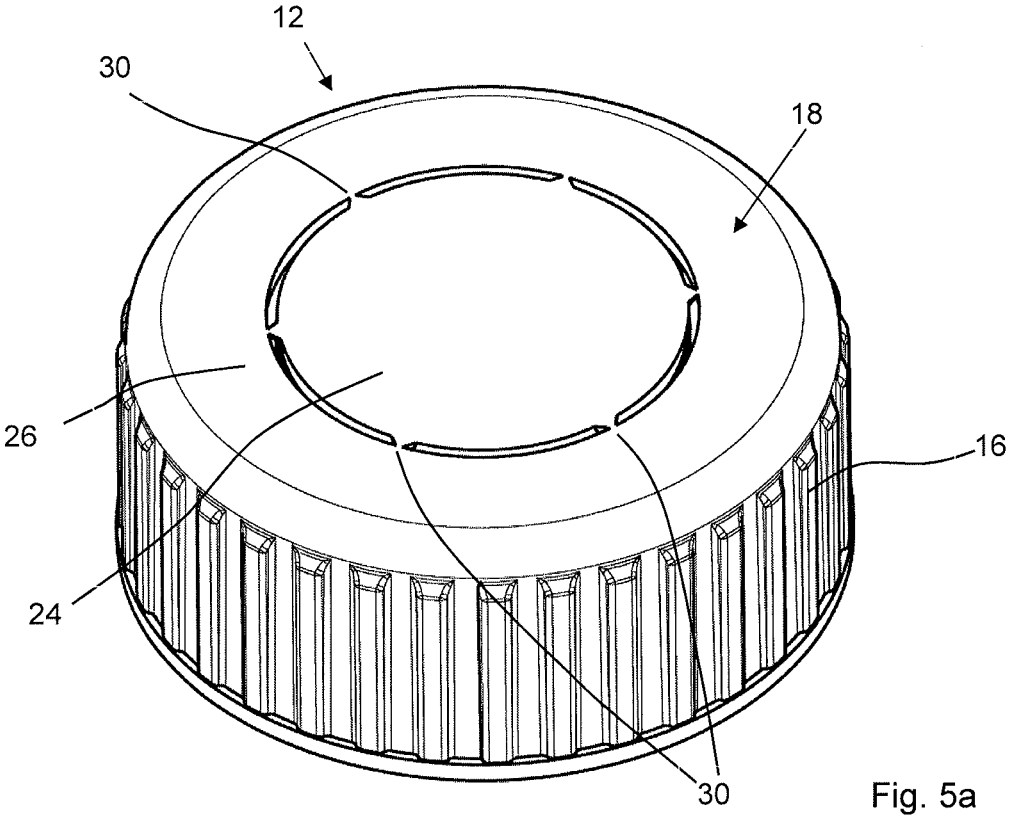
FIG. 5*a* is a top view of the outer cap according to the embodiment of FIG. 3.

The first top wall 18 comprises a tamper-evident member 24 and the surrounding region 26. The tamper-evident member 24 is connected to the surrounding region 26 by a frangible means 30. The frangible means can be frangible bridges 30 as shown in the examples of FIG. 1 and FIG. 5*a*. As an alternative, it is also possible to fully surround the tamper-evident member 24 by material with a reduced thickness.

Figure 2:
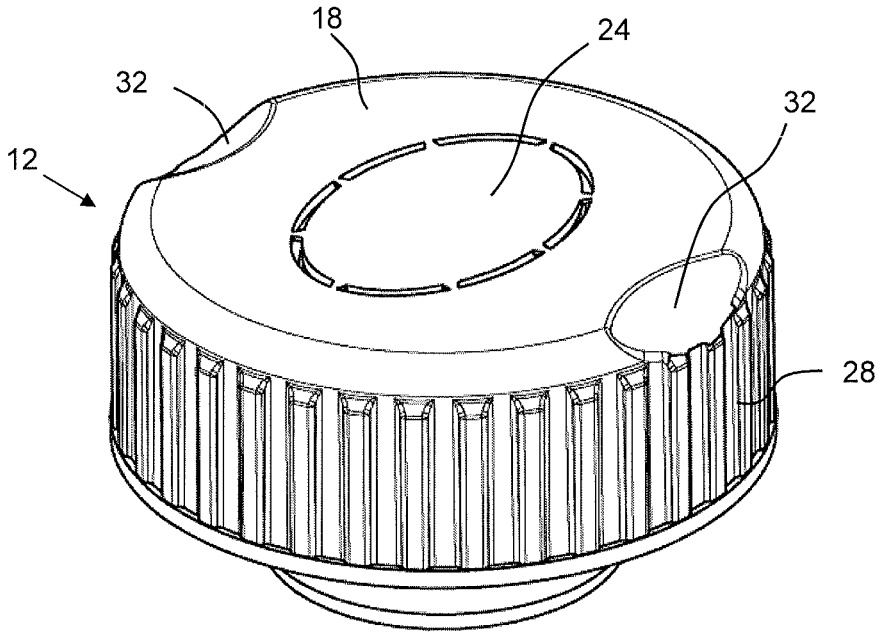
FIG. 2 shows a further embodiment of an inventive closure.

The geometry of the outer cap 12 as shown in FIG. 1 only serves as an example and different geometries are possible as long as the tamper-evident member 24 is positioned at the first top wall 18 of the outer cap 12. In the schematic example as shown in FIG. 2, the first top wall 18 is provided with depressions 32. Two or more of the depressions 32 may be provided. The depressions 32 can be in positions diametrically opposite to each other or distributed at equal pitch or unequal pitch about the circumference of the first top wall 18. The depressions 32 serve to further improve the grip of a user who, as will be explained in detail below, has to have a firm grip on the outer cap 12 in order to shift it both in an axial direction and thereafter to rotate it.

FIG. 3 is a cross sectional view of the neck portion 34 of the container 20 with a closure 10 according to the invention. The closure 10 consists of the outer cap 12 and the inner cap 14. The inner cap 14 is provided with an internal thread 36 the shape of which is adapted to cooperate with the external thread 22 of the container 20. In this manner, the closure 10 can be simply screwed onto the neck of the container by rotation in e.g. a clockwise direction.

The inner cap 14 is provided with a sealing skirt 38 which is arranged so that it establishes a sealing contact with the inner wall surface 40 of that part of the container 20 which surrounds the dispensing opening thereof. The sealing skirt 38 can be provided with an annular, outwardly protruding bead (not shown) in order to further improve the sealing capability of the sealing skirt 38.

The inner cap 14 is provided with a second sidewall 42 and a second top wall 44. The top wall 44 is provided with a protrusion 46. In the example according to FIG. 3, the protrusion 46 has a geometry which corresponds to the geometry of the tamper-evident member 24 being part of the first top wall of the outer cap 12. As will be explained below, the protrusion 46 serves to remove the tamper-evident member 24 by breaking the frangible bridges 30 between the tamper-evident member 24 and the surrounding region 26 once the outer cap 12 will be axially displaced towards the inner cap 14.

The inner cap 14 is further provided with a desiccant chamber 48. It is formed by an annular sidewall 50, also shown in FIG. 4*b*, and suitable closing means 52 in order to close the desiccant chamber 48 with a gas permeable cover 54 which retains the desiccant material inside the desiccant chamber 48. As an alternative not shown in FIG. 3, the inner cap 14 could also be provided with a suitable attachment structure for holding a prefabricated canister containing an active agent according to the specific contemplated use of closure 10.

On the internal side of the first sidewall 16 a radially inwardly extending bead 56 is provided which, in the mounted state of the outer cap 12 on the inner cap 14, forms a positive lock with a radially outwardly extending flange 58 on the second sidewall 42 of the inner cap 14. The bead 56 and the flange 58 cooperate in a way so as to firmly hold the outer cap 12 on the inner cap 14 so that it can no longer be removed from the inner cap 14.

Figure 4A:
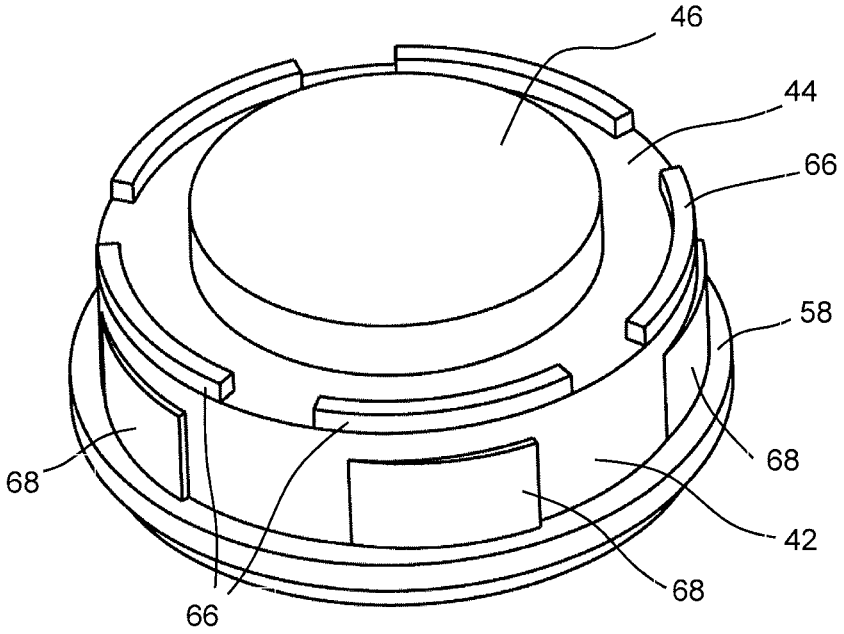
FIG. 4*a* is a top view of the inner cap according to the embodiment of FIG. 3.
Figure 4B:
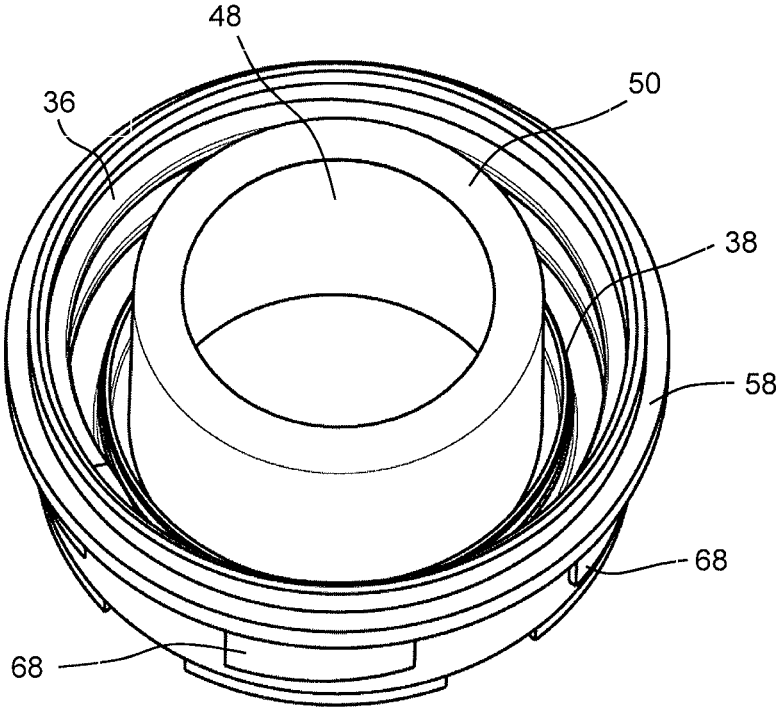
FIG. 4*b* is a bottom view of the inner cap of FIG. 4*a;*
Figure 5B:
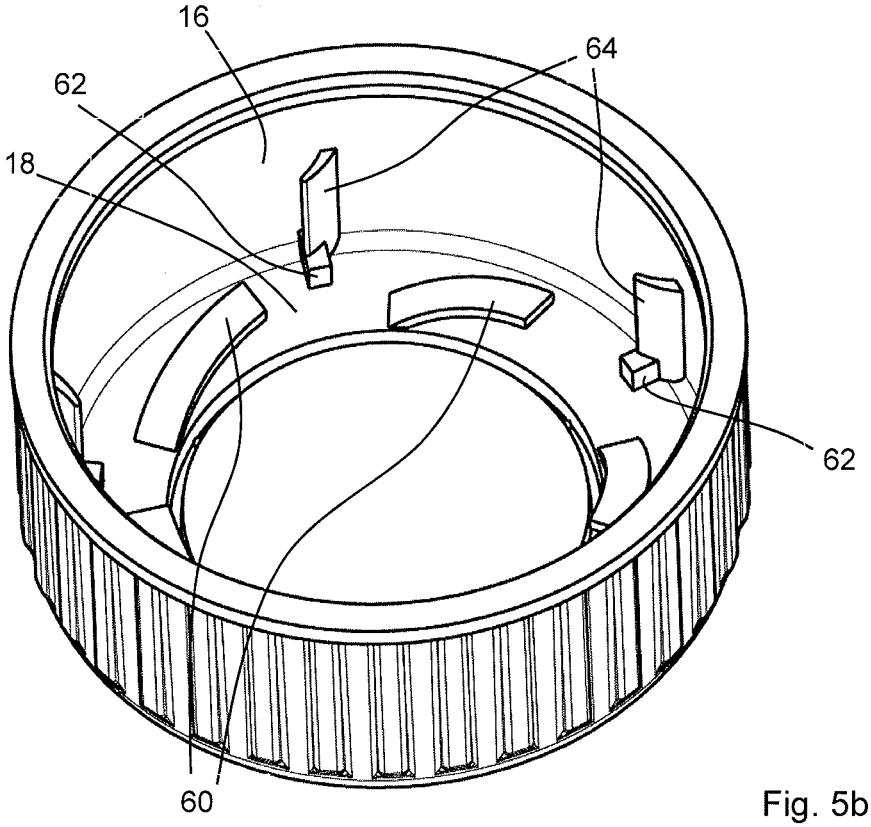
FIG. 5*b* is a bottom view of the outer cap of FIG. 5*a;*

FIGS. 4*a* and 4*b* show the top view and the bottom view of the inner cap 14, respectively, whereas FIGS. 5*a* and 5*b* show the top view and the bottom view of the outer cap 12, respectively.

The top view of FIG. 5*a* corresponds to that as already shown in FIG. 1 so that except for a better representation of the frangible bridges 30 in FIG. 5*a*, reference can be made to the detailed explanation of the outer cap 12 in the description of FIG. 1 above.

FIG. 5*b* shows several elements inside the outer cap 12, the function of which will be detailed in the following. Firstly, there are blade-like interacting elements 64 which are formed starting from the inner wall surface of the first sidewall 16.

Secondly, there are driving members 62 on that side of the first top wall 18 which, in the mounted state, faces the wall 44 of the inner cap 14. Finally, on the side of the first top wall 18 facing the inner cap 14, a plurality of elastic members 60 are provided which are formed integrally with the first top 18.

The inner cap 14 is provided with elements cooperating with the interacting elements 64 and the driving members 62. FIG. 4*a* shows the protrusion 46 on the second top wall 44. Further, the second top wall 44 is provided with serrations 66 which, in the mounted state, cooperate with the driving members 62 on the outer cap 12, whereby the first engagement means is formed. Extending from the second side wall 42 inclined surfaces 68 are provided which, in the mounted state, cooperate with the blade like interacting elements 64 forming the second engagement means.

In operation, the outer cap 12 and the inner cap 14 nested therein can be rotated together for screwing the closure 10 onto the container 20. The clockwise rotation direction for screwing the closure 10 onto the container brings the blade-like interacting elements 64 in engagement with the beveled or inclined surfaces 68. The beveled or inclined surfaces 68 provide an abutment which interacts with the blade-like interacting elements 64 provided on the internal side of the outer cap 12. This interaction is only possible when closing the closure 10 on the container 20 which is usually in a clockwise direction. When a user rotates the outer cap 12 in a counterclockwise direction in an attempt to open the closure 10, the blade-like interacting elements 64 slip over the beveled inclined surfaces 68. As a result, the rotation of the outer cap 12 will not lead to a corresponding rotation of the inner cap 14. However, it should be apparent that the same basic construction and functionalities can be provided in case that the rotational direction for closing and opening the container should be reversed.

An opening of the closure 10 requires that the driving members 62 of the outer cap 12 are brought in engagement with the serrations 66 of the inner cap 14. This is only possible after the outer cap 12 has been axially displaced towards the inner cap 14 against the retaining force of the elastic members 60. Only after the application of a pushing force onto the top surface of the outer cap 12, the driving members 62 can interact with the serrations 66 so that rotation of the outer cap 12 in a counterclockwise direction will also rotate the inner cap 14 in the same direction.

The elastic members 60 allow the disengagement of the driving members 62 and serrations 66 once the axial pressure on the outer cap 12 is released so that the elastic members 60 return to their relaxed position and displace the outer cap 12 in an axial direction away from the inner cap 14.

As a result, the closing of the closure 10 onto a container is easy to achieve and only requires a simple rotational movement of the outer cap 12, whereas the opening of the closure 10 requires a complex operation starting with an axial displacement of the outer cap 12 towards the inner cap 14 under axial pressure, followed by a rotational movement while maintaining the axial pressure. Such complex operation establishes a highly effective child resistance.

When first using the closure 10, the axial displacement of the outer cap 12 towards the inner cap 14 is used to break the frangible means 30 between the tamper-evident member 24 and the surrounding region 26 of the first top wall 18 of the outer cap 12. Thus, when first pushing down the closure 10, the frangible connections of the tamper-evident member 24 are broken and the tamper-evident member 24 separates from the surrounding region 26 of the first top wall 18.

Alternatively, the tamper-evident member 24 may completely manually be removed including breaking the frangible means. For this purpose, a tongue or latch or an opening in the tamper-evident member 24 may be provided. According to a preferred embodiment, however, the protruding element is used to break the frangible means.

The tamper-evident member 24 can be integrally formed with the first top wall 18 of the outer cap 12. It can be of a different colour and/or material than the surrounding region 26 of the first top wall 18. This can be realized by means of a bi-injection moulding process. It is either possible to first mould the tamper-evident means and then, moulding from the existing mould the surrounding region 26 of the first top wall 18 and the first sidewall 16 of the outer cap 12, or to first mould the outer cap 12 with a hollow space on its top wall and then to mould from the existing mould the tamper-evident member. By using a colour for the tamper-evident member that is different from the colour of the remaining part of the outer cap 12, the tampering becomes more evident.

A preferred solution uses a different colour at least in part for the protrusion 46 of the inner cap 14. After the tamper-evident member 24 has been removed, the different colour of the protrusion 46 can be seen and serves as a clear indication for the tampering.

Preferably, the tamper-evident member 24 is removed after the frangible means has been broken. It can comprise a window allowing the passing of a finger of the user for its easy removal. It can further comprise a seizure member that extends outwardly from the top surface of the tamper-evident member for facilitating its removal before the closure is first opened by the above-described complex operation starting with pushing down the outer cap 12 towards the inner cap 14. In other words, independent of the specific embodiment as described here, the provision of a window for the removal of the tamper-evident member 24 after the frangible means have been broken, or the removal of the tamper-evident member 24 before pushing down the outer cap 12 by means of a seizure member are possible.

In the embodiment as described with reference to FIGS. 3, 4*a*, 4*b*, 5*a* and 5*b*, the protrusion 46 is shaped to correspond to the shape of the tamper-evident member 24. However, this is not a requirement and instead of the protrusion 46, one or a plurality of smaller protrusions can be provided while maintaining the same function.

Nevertheless, it can be advantageous to select the shape of the protrusion 46 such that it corresponds to the geometry of the tamper-evident member 24.

Figures 7A, 7B, 7C:
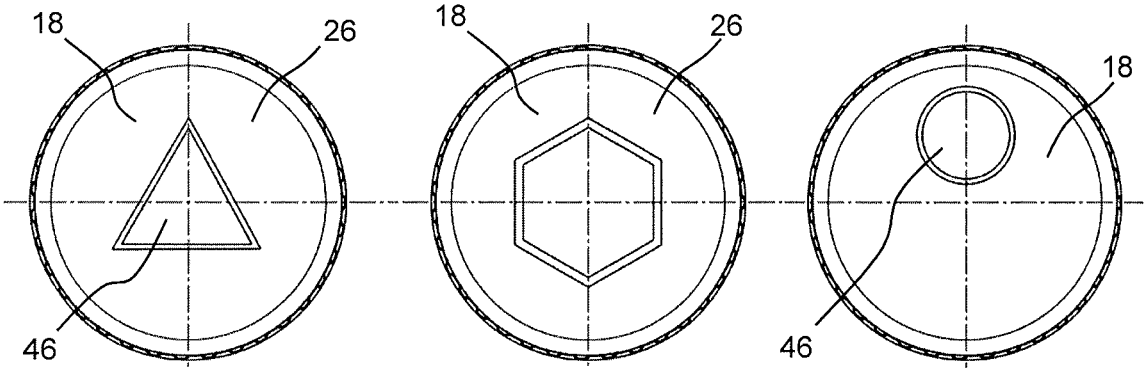
FIGS. 7*a*, 7*b* and 7*c* are schematic top views of various embodiments of the invention.

FIGS. 7*a*, 7*b* and 7*c* schematically describe a further embodiment of the closure 10 in which the cooperating engagement means are provided by the interaction between the protrusion 46 and the surrounding region 26. In such a case, the driving members 62 and the serrations 66 are no longer required because their function as an engagement means is incorporated in the interaction between the protrusion 46 and the surrounding region 26 around the tamper-evident member 24.

Turning now to FIGS. 7*a* and 7*b*, different geometries of the surrounding regions 26 of the first top wall 18 after removal of the tamper-evident member 24, and of the protrusions 46 are shown. It can be seen that the protrusions 46 will provide a form lock interaction with the surrounding region 26 once the outer cap 12 has been axially displaced towards the inner cap 14 so that the protrusion 46 extends through the opening in the surrounding region 26. The form lock interaction between the outer cap 12 and the inner cap 14 allows the unscrewing of the closure 10 from the container 20.

The embodiment according to FIG. 7*c* does not use a mutual geometry of the protrusion 46 and the opening in the surrounding region 26 which automatically generates a form lock interaction, but places the protrusion 46 and the opening in the surrounding region 26 in an off-center position on the first top wall 18 such that a rotation R of the outer cap 12 will also rotate the inner cap 14 if the protrusion 46 extends into the opening in the surrounding region 26.

Throughout the embodiments as described above, the inner cap 14 is provided with the protrusion 46 which can be used to break the frangible means 30 around the tamper-evident member 24 in the first top wall 18 of the outer cap 12. However, it is also possible to provide a protrusion on that side of the tamper-evident member 24 which, before the frangible means 30 has been broken, faces towards the second top wall 44 of the inner cap 14.

Figure 6:
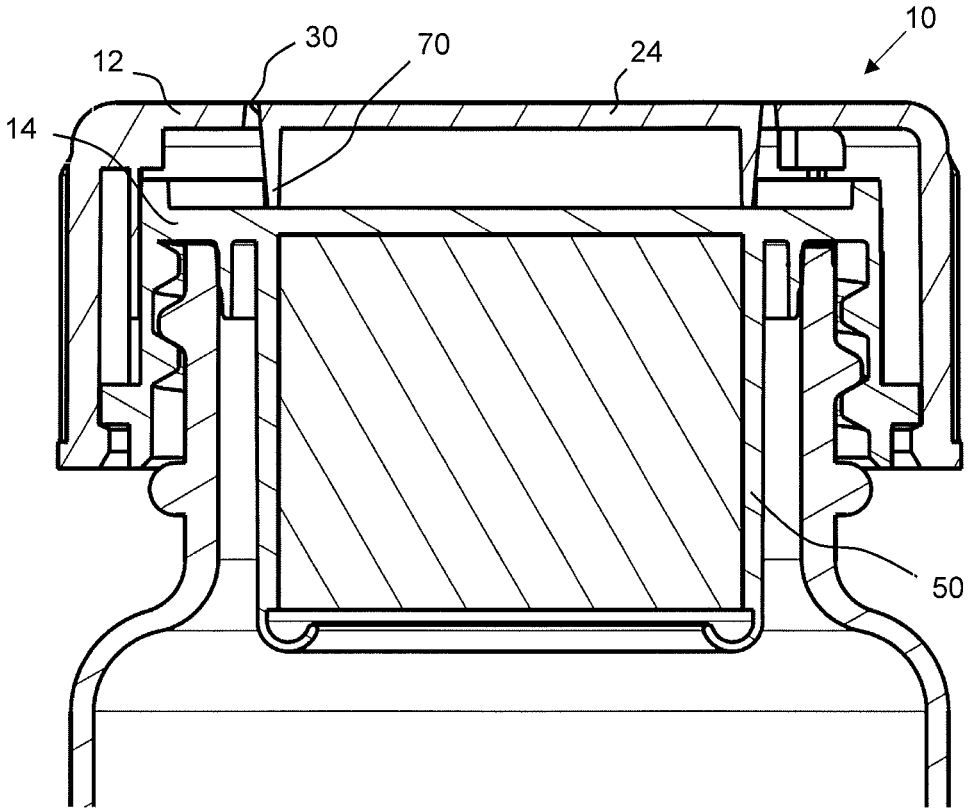
FIG. 6 is a cross-sectional view of a part of an example container with a closure according to a further embodiment of the invention.

FIG. 6 shows a partial cross section of the closure 10 according to a further embodiment of the invention. As can be seen in FIG. 6, the basic elements of the closure 10 are identical or at least very similar to those as described in the context of the embodiment of FIG. 3. The basic difference is the provision of one or a plurality of protruding elements 70 on the tamper-evident member 24. The operation of the closure 10 according to FIG. 6 is the same as that as explained in detail above. An axial displacement of the outer cap 12 towards the inner cap 14 brings the protruding element 70 in abutting contact with the second top wall 44 of the inner cap 14 and breaks the frangible bridges 30 around the tamper-evident member 24.

FIG. 8 shows an even further embodiment of the invention. The outer cap 12 shown in FIG. 8*a* omits the elastic members 60 described previously. Hence, in this embodiment, the outer cap 12 is not biased away from the inner cap 14 shown in FIG. 8*b*.

Figure 8A:
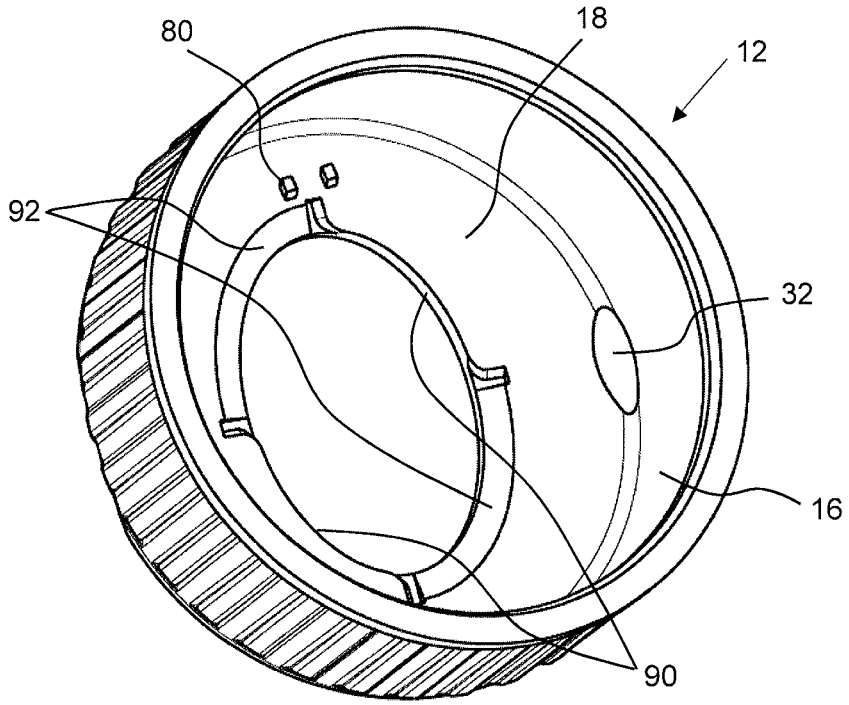
FIG. 8*a* is a bottom perspective view of the outer cap of a further embodiment of the invention with the tamper-evident member being removed.

Further, the tamper-evident member 24 has already been removed in FIG. 8*a* for clarity reasons leaving an opening 96 in the top wall 18 of the outer cap 12. The opening 96 is defined or limited by diametrically opposite straight edge portions 90 (substantially parallel to a rotation axis or "axial direction" of the closure) and diametrically opposite beveled edge portions 92 (slanted relative to the rotation axis of the closure). In other words, the beveled edge portions 92 have slanted surfaces starting at an edge of the opening 96 (or the tamper-evident member 24) and slanting away from the opening (or the tamper-evident member 24) towards the inner cap 14.

Figure 8B:
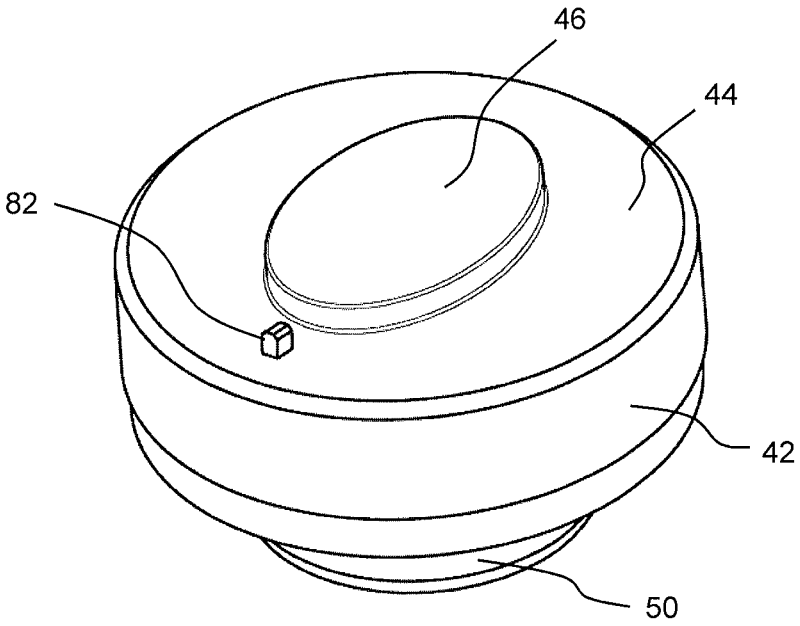
FIG. 8*b* is a top perspective view of the inner cap of the further embodiment of the invention.

The shape of the opening 96 and, hence, the tamper-evident member 24 and of the protruding element 46 shown in FIG. 8*b* match each other (both are oval in this embodiment).

Further, two protrusions 80 as first landmark element and a protrusion 82 as second landmark element are provided at the facing sides of the first top wall 18 and the second top wall 44, respectively.

The remainder of the configuration is similar to the previous embodiments and a detailed description thereof will be omitted.

Figure 8C:
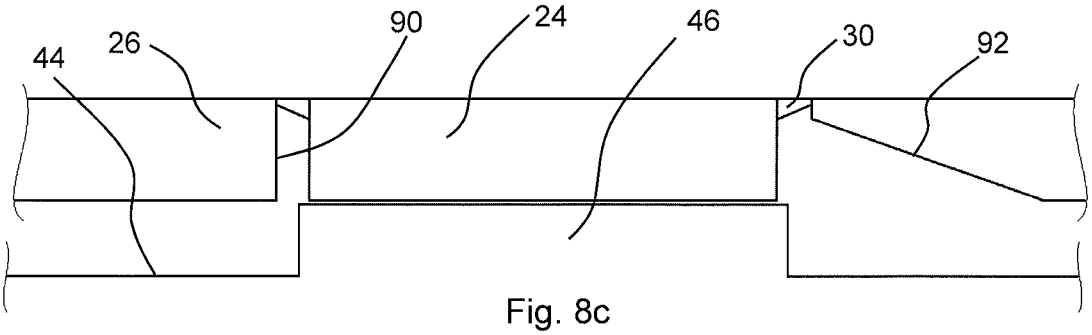
FIG. 8*c*, 8*d*, 8*e* are schematic cross-sectional views of the outer cap and the inner cap shown in FIGS. 8*a* and 8*b* in different stages of use.

Before use of the closure 10, the tamper-evident member 24 is fixed via the frangible means 30 to the surrounding region 26 of the outer cap 12 as shown in FIG. 8*c*. As with the other embodiments, application of an axial force on the outer cap 12 presses the tamper-evident member 24 against the protruding element 46, whereby the frangible means 30 is broken and the tamper-evident member 24 can be removed. As the shape of the protrusion 46 and the tamper-evident member 24 is oval in this embodiment, the protrusion 46 and the tamper-evident member 24 will have to be aligned in order to separate the tamper-evident member 24 from the outer cap 12. For this purpose, the outer cap 12 is rotated until the protrusion 82 engages with or contacts one of the protrusions 80, whereby the user obtains a sensible feedback and may, thus, conclude that the protrusion 46 and the tamper-evident member 24 are aligned. Subsequently, the axial force is applied onto the outer cap 12 as previously described.

Figure 8D:
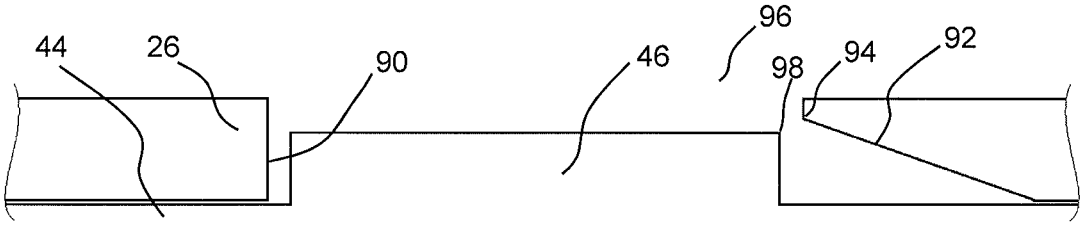

In this alignment position as shown in FIG. 8*d* a force-fit will be established between the straight edge portion 90 of the opening 96 and the facing outer edge (sidewall) of the protruding element 46 (see FIG. 8*d* on the left-hand side). As the protruding element 46 and the opening 96 are oval, the force fit is active in the clockwise direction (direction of closing the closure). Hence, the inner cap 14 is rotated together with the outer cap 12 even without an axial force being applied when rotating the outer cap 12 in the second rotational direction (closing the closure).

Figure 8E:
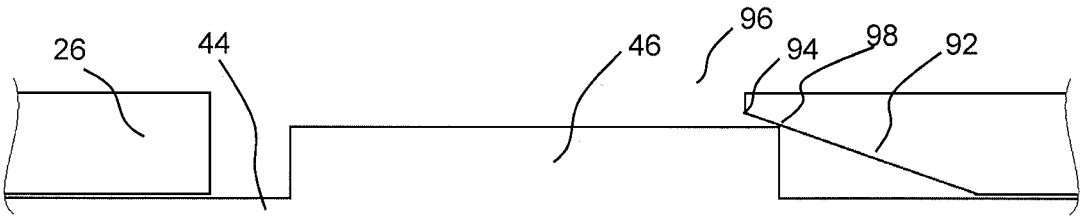

According to FIGS. 8*d* and 8*e*, an outer edge is formed at an end of the beveled edge portions 92 at the opening. This outer edge also extends substantially parallel to the axial direction and has a lower corner 94. This lower corner 94 of the outer edge is located higher than the top surface or top corner 98 of the protruding element 46 when the outer cap 12 rests on the inner cap 14 even without any forces being applied. To put it differently, there is a distance between the lower corner 94 and the top corner 98 of the protruding element 46. Accordingly, when the outer cap 12 is rotated in the first rotational direction (opening the closure), the outer cap 12 rotates above the top corner of the protruding element 46 which slides along the beveled edge portions 92. As only a line contact is established between the top corner 98 of the protruding element 46 and the surface of the beveled edge portions 92, the rotation of the outer cap 12 is not transferred to the inner cap 14. In order to transfer the mechanical torque, an axial force has to be applied to the outer cap 12, whereby the beveled edge portions 92 are firmly pressed against the top corner 98 of the protruding element 46 and the rotation can be transferred from the outer cap 12 to the inner cap 14. Accordingly, the rotational force in the first rotational direction is transferred upon application of the axial force plus a turning mechanical torque on the outer cap 12 in order to also rotate the inner cap 14 and thereby open the closure. The engagement between the beveled edge portions 92 and the top corner 98 of the protruding element 46 forming the engagement means is in this case a frictional engagement.

A further embodiment not shown in the drawings combines the general principles laid down in FIGS. 3 and 6. The provision of a protrusion 46 as shown in FIG. 3 can be combined with the provision of a protruding element 70 as shown in FIG. 6.

FIGS. 9 to 20 show a further embodiment and a variant thereof of the child-resistant and tamper-evident closure according to the invention.

Figure 9:
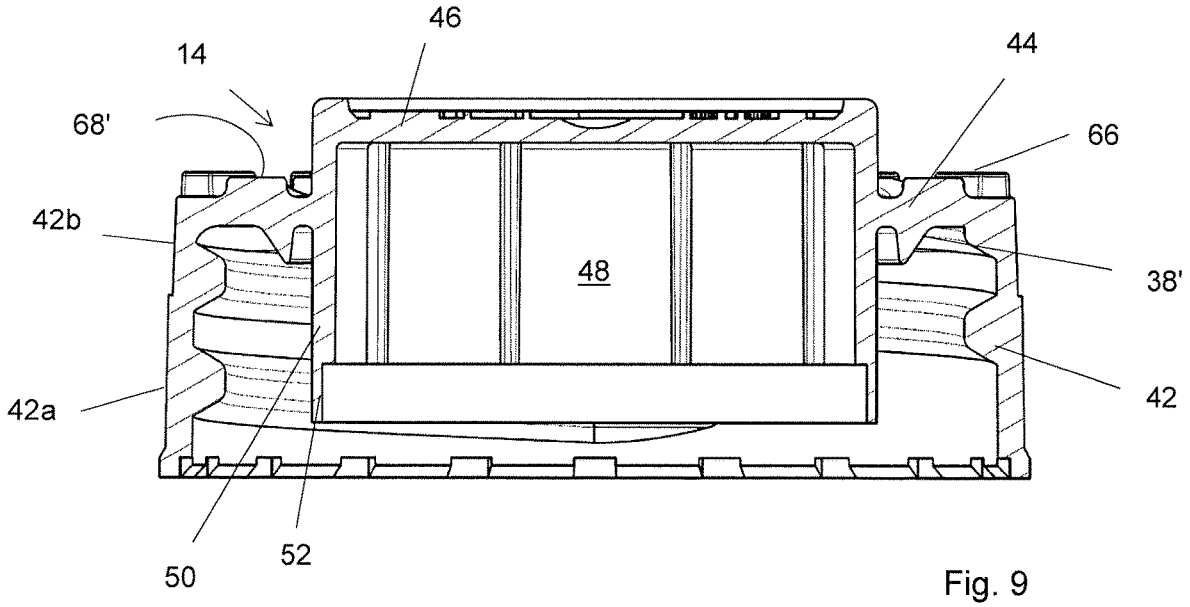
FIG. 9 is a cross-sectional view of the inner cap according to a further embodiment of the invention.

FIG. 9 is a cross-sectional view of the inner cap. Due to the high similarities to the inner cap as shown e.g. in FIGS. 3, 4*a* and 4*b*, in the following reference will be made to the specific differences over the inner cap of the closure according to FIGS. 3, 4*a* and 4*b*. Firstly, the inner cap 14 is shown as it is molded. The desiccant chamber 48 has not yet been filled with sorbent material, closed with a permeable material, and the closing means 52, which are extensions of the annular wall 50 with reduced wall thickness have not been crimped to close the container. The same inner cap mounted within the closure, wherein the desiccant chamber 48 is filled with sorbent material and closed can be seen in FIG. 20.

Figure 11:
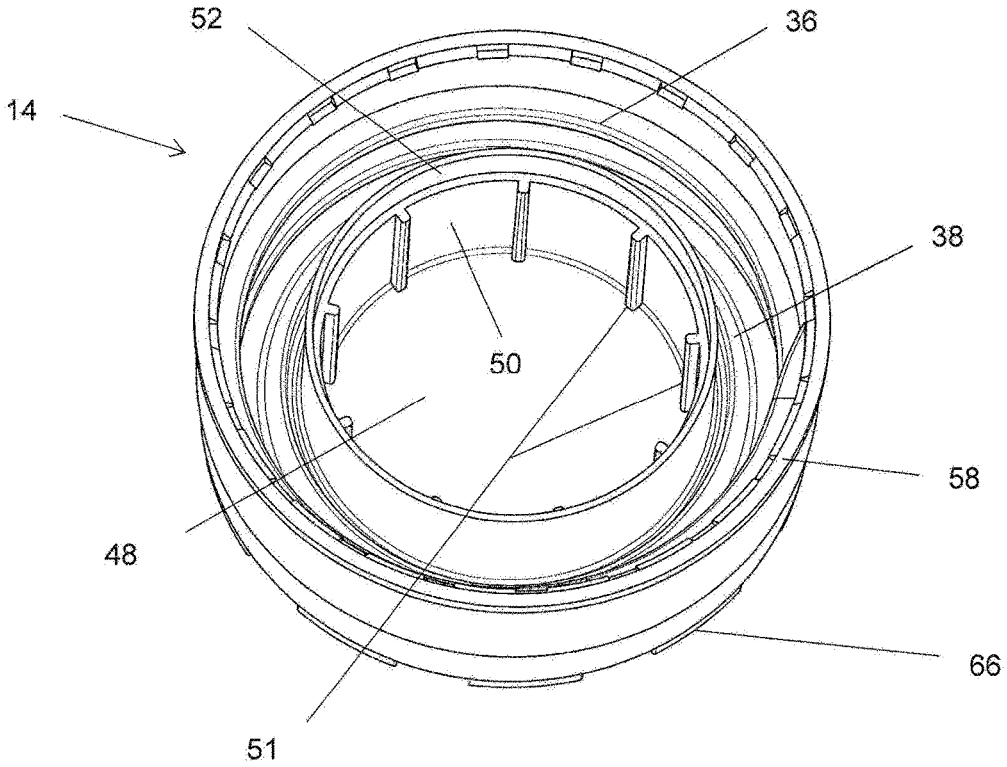
FIG. 11 is a bottom perspective view of the inner cap according to FIG. 9.

A first difference over the geometry of the inner cap as shown e.g. in FIG. 3 is the size of the desiccant chamber which can be freely adapted to the specific needs and, in the example of FIG. 9, is smaller than that as shown in FIGS. 3 and 4*b*. The vertical ribs 51 as shown in FIG. 11 are provided in order to improve the support of the closing means 54 (see FIG. 20), which is often made of cardboard, once the desiccant chamber has been filled with sorbent material.

Figure 20:
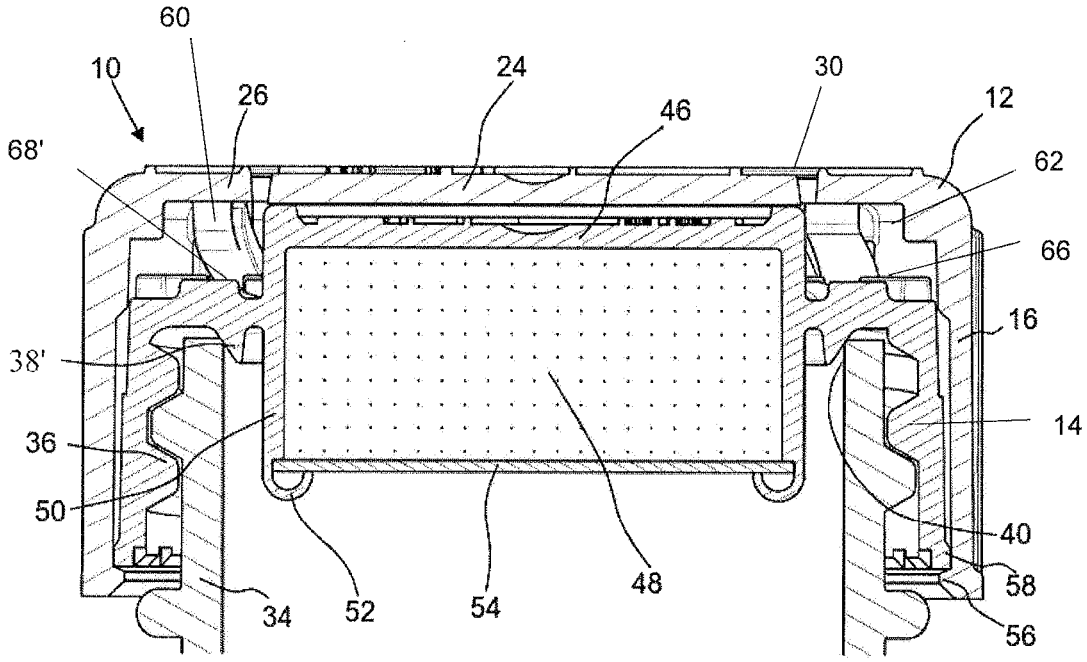
FIG. 20 is a cross-sectional view showing the assembly of the inner cap of FIG. 9 with sorbent chamber and the outer cap according to FIGS. 13 to 19 screwed onto a bottle neck.

A second difference is the shape of the sealing skirt 38' which distinguishes from the sealing skirt 38 as shown in FIG. 3 in that it has an inwardly slanted external sealing surface. The inwardly slanted external sealing surface promotes the tightness of the inner cap when used on standardized bottles or containers. This is based on the fact that the inwardly slanted external sealing surface can be more easily adapted to different dimensional variations of the inner side of the neck of the bottle or container on which the inventive closure is used. Because of the slanted sealing surface, the sealing contact is likely to be a line contact only so that tolerances and even small irregularities of the dimensional variations of the neck of the bottle or container can be accounted for. As can be seen in the mounted state on an example container as shown in FIG. 20, there is a line contact between the sealing surface and the inner edge of the neck of the container which provides a better sealing contact due to the deformation of the sealing surface along the contact line. Further, dimensional variations in the thickness of the mouth of the container can easily be adapted.

A further difference which is independent of the inwardly slanted external sealing surface is a small step in the outer diameter of the inner cap. In other words, the outer surface of the second sidewall 42 comprises a region 42*a* with a slightly lager outer diameter and a second region 42*b* in which the outer diameter of the inner cap is slightly smaller. This difference of the outer diameter of the inner cap allows an easy and quick assembly of the inner cap into the outer cap and reduces the reject rate. Since the region 42*b* with the smaller diameter is closer to the top of the inner cap as compared to the region 42*a* with a larger diameter, it is easier to center the inner cap for the assembly within the outer cap. If the orientation of the inner cap relative to the outer cap is not perfectly centered, the inner cap will still enter the outer cap and is self-centered therein during assembly. This simplifies a high-speed process of assembly.

A further difference as compared to the previous embodiments is the position of the inclined surfaces 68' which, in the embodiment according to FIGS. 3, 4*a* are positioned at the sidewall of the inner cap. In the present embodiment, the inclined surfaces 68' are on the top wall 44 of the inner cap. The advantage of such position of the inclined surfaces 68' is that the inner diameter of the outer cap can be designed to be close to the outer diameter of the inner cap so that the inventive closure can be designed with a smaller outer diameter of the outer cap and becomes more compact.

Figure 12:
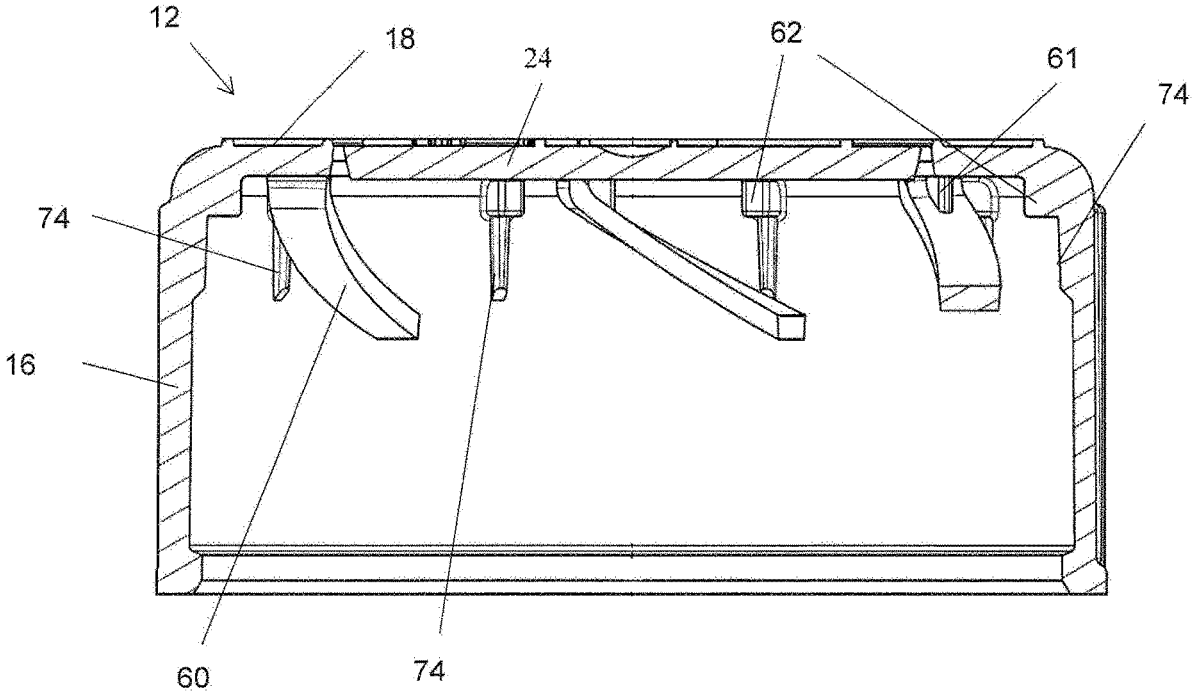
FIG. 12 is a cross-sectional view of the outer cap according to the embodiment of FIG. 9.

Preferably, there are at least 10 inclined surfaces 68' distributed over the second top wall 44. The advantage of a higher number of inclined surfaces 68' is that the angle between the step portions of consecutive, wedge-shaped elements with the inclined surfaces 68' is less than 20°. During the opening and without applying downward pressure on the outer cap, the inclined surfaces cooperate with the elastic members 60 of the outer cap as shown in FIG. 12. Preferably, the number of the inclined surfaces 68' is twice the number of the elastic members 60. Therefore, during opening and without applying a downward pressure, the elastic members 60 slide over the inclined surfaces 68' and give an audible indication as soon as the outer cap 12 has been rotated by around 20° or less relative to the inner cap 14. Preferably, there are at least 10 audible indications per revolution.

During the closing operation, the free end of the elastic members 60 move down the inclined surfaces 68' and will be stopped at the step portions 69. In this way, the closing can be carried out by a simple rotation of the outer cap without requiring a downward pressure. The height of the step portions 69 is preferably at least 0.8 mm.

Figure 10:
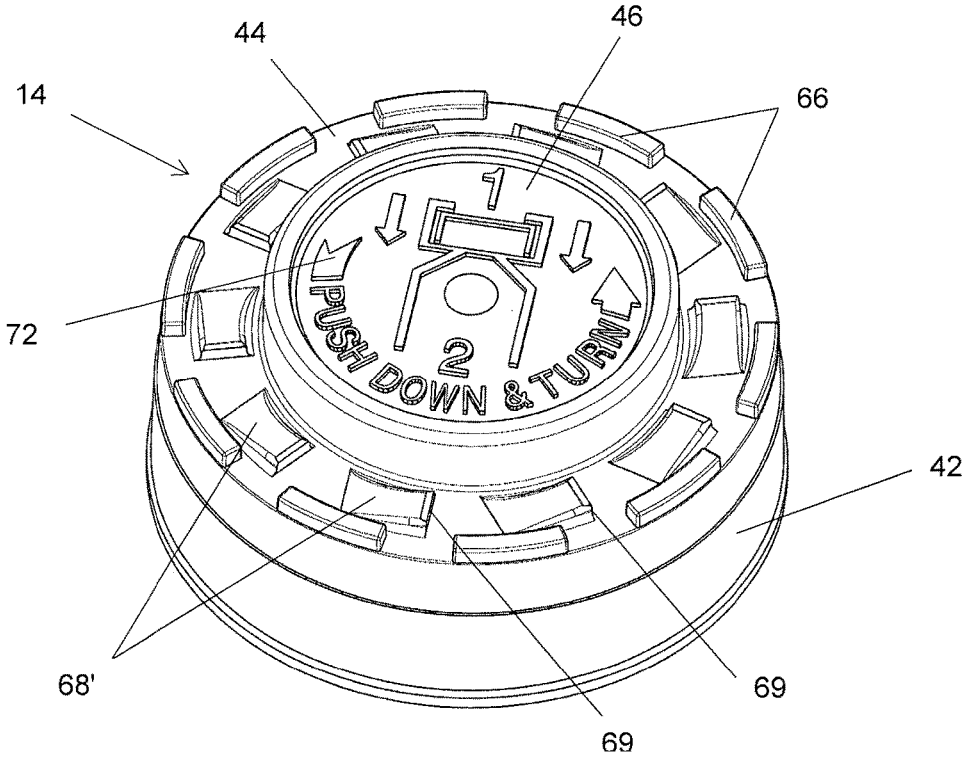
FIG. 10 is a top perspective view of the inner cap according to FIG. 9.

Further, in the embodiment according to FIG. 10, a higher number of serrations 66 have been provided. The increase of the number of serrations 66 as compared to the embodiment of FIGS. 3, 4*a* and 4*b* also contributes to a more efficient opening of the closure once the driving members 62 (see FIGS. 13 and 14) of the outer cap were brought in engagement with the serrations 66 of the inner cap 14. Preferably, the number of the serrations 66 should be at least 10. Preferably, the angle between the same point of two consecutive serrations 66 should be less than 40°.

Turning now to FIG. 12, a cross-section of the outer cap suitable for the inner cap as shown in FIGS. 9 to 11 is shown. Like in the embodiment as shown in FIGS. 5*a* and 5*b*, the outer cap 12 is provided with a first sidewall 16, a first top wall 18 and a tamper-evident member 24. There are driving members 62 for cooperating with the serrations 66 in the process of opening the closure.

Figure 13:
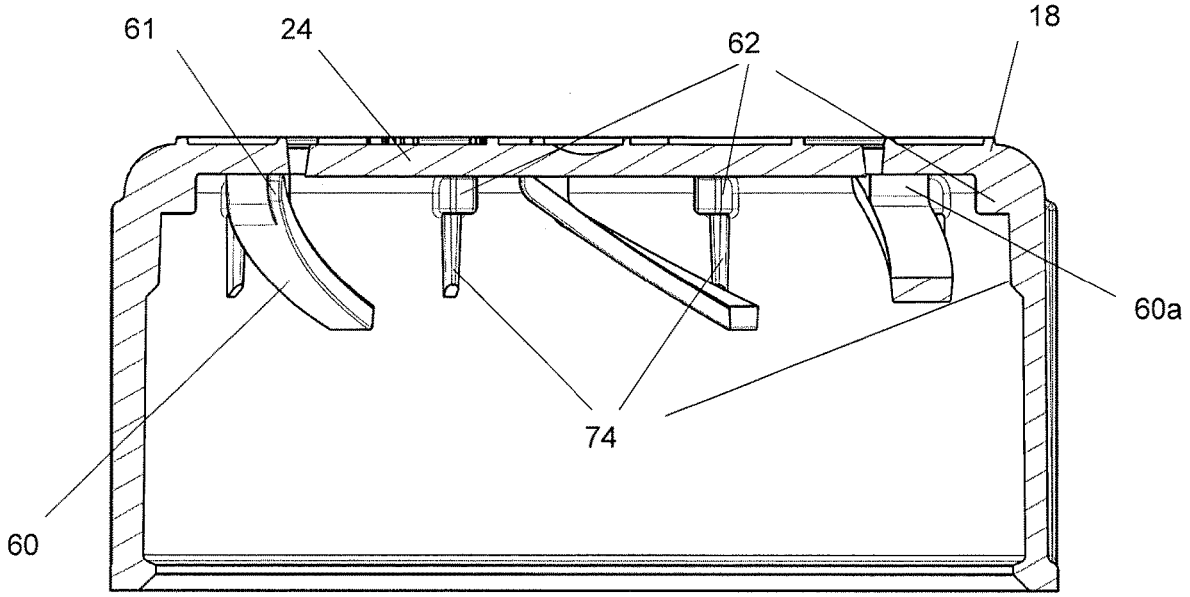
FIG. 13 is a variant of the embodiment according to FIG. 12 and shows a cross-sectional view along line A-A in FIG. 14.
Figure 14:
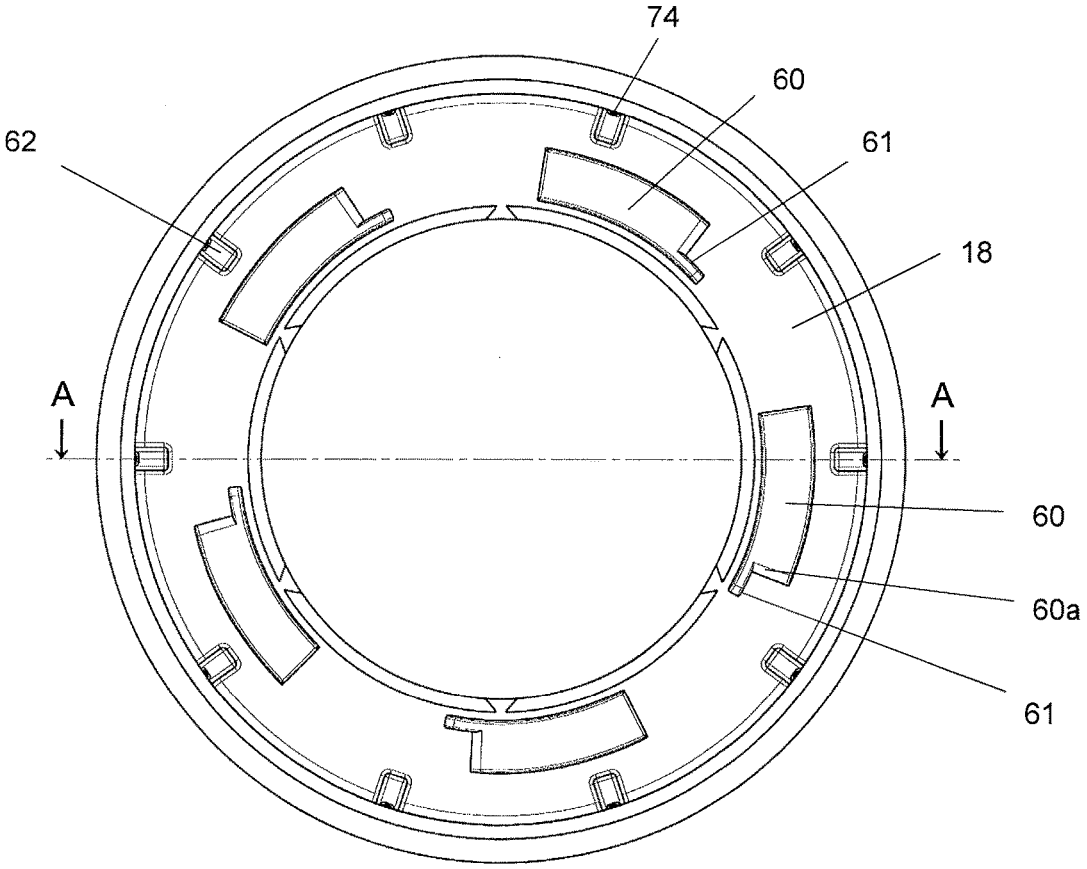
FIG. 14 is a view from below of the outer cap according to FIG. 13.

In addition to the embodiment as shown in FIGS. 5*a* and 5*b*, the outer cap is provided with centering ribs 74, which can also be seen in FIGS. 13 and 14. Due to the difference of the outer diameter of the inner cap along the height of the inner cap, the ribs 74 are provided to re-center the inner cap inside the outer cap after it has been assembled. Thus, the gap between the inner diameter of the sidewall of the outer cap and the outer diameter of the inner cap in the region 42*b*, in which the outer diameter of the inner cap is slightly decreased, is compensated by the centering ribs 74 whose length is also adapted to extend over at least a major part of the height of the region 42*b*.

The major difference between the outer cap as shown in FIG. 12 and that as shown in FIG. 5*b* is the provision of one single set of elastic members 60 and the omission of the blade-like interacting elements 64 as shown in FIG. 5*b*. The elastic members 60 have a basis 60*a* at which they are attached to the top wall of the outer cap. The basis 60*a* extends substantially perpendicularly from the top wall followed by a transitional section in which the elastic member 60 changes its direction into the angular position as shown. In order to impart a sufficient strength to the elastic members 60, a reinforcing rib 61 is provided which extends between the lower surface of the top wall 18 and the elastic member 60 close to its starting end of the basis 60*a* where it is attached to the top wall 18. The reinforcing rib 61 preferably does not extend over the whole width of each elastic member 60.

The elastic member 60 according to the present embodiment has an increased robustness and stiffness as compared to the embodiment as shown in FIG. 5*b*. It has been found that the specific design of the elastic means as described in this application, allows for maintaining the child resistant properties of the stopper, even if the elastic means have been forced by application of an excessive torque when closing the cap. In such case, the elastic means will be returned, but will maintain their function to space away the outer cap from the inner cap. In their original configuration, the inclined portion of the elastic means is extending in screwing direction when starting from the base portion. Once the inner cap has been fully screwed on the container neck, a possible misuse of the cap consists in turning the outer cap into screwing direction, without simultaneous application of a vertical force. In such a case, the elastic means will abut the locking surface of the wedge-shaped element and under application of an excessive torque, the elastic means can be forced. As a result, the inclined portion of the elastic means will then extend in the opposed direction (unscrewing direction) when starting from the base portion, in a substantially symmetrical geometry when compared to their original configuration. This result is obtained from the provision of the substantially perpendicular portion 60*a* attaching the elastic means to the top surface of the inner cap and of the curved transition portion between the perpendicular portion and the inclined portion of the elastic means.

In FIG. 13, a cross-sectional view of the outer cap is shown which has a high similarity to that as shown in FIG. 12. What is different is the geometry of the elastic members 60 close to their basis where they are attached to the lower side of the top wall 18. FIG. 13 is a cross-sectional view along the line A-A of FIG. 14. In the embodiment of FIGS. 13 to 19, the basis 60*a* of the elastic means 60 also extends substantially perpendicularly from the lower surface of the top wall 18. This can be best seen in FIGS. 17 and 18. In FIG. 14, the basis 60*a* of the elastic members 60 can be seen. In addition to this, a reinforcing rib 61 is provided which, as can be best seen from the top view as shown in FIG. 19 has a width which is smaller than that of the basis 60*a* and is arranged next to the basis 60*a* in a width direction of the elastic member 60.

As can be seen from FIG. 14, there are only 5 elastic members 60 provided on the lower surface of the top wall 18, whereas in FIG. 10 there are 10 inclined surfaces. The total numbers are of minor importance but it is preferred that the number of inclined surfaces is twice the number of the elastic members.

Preferably, the space between two consecutive elastic means is substantially the same as an elastic means.

Figure 16:
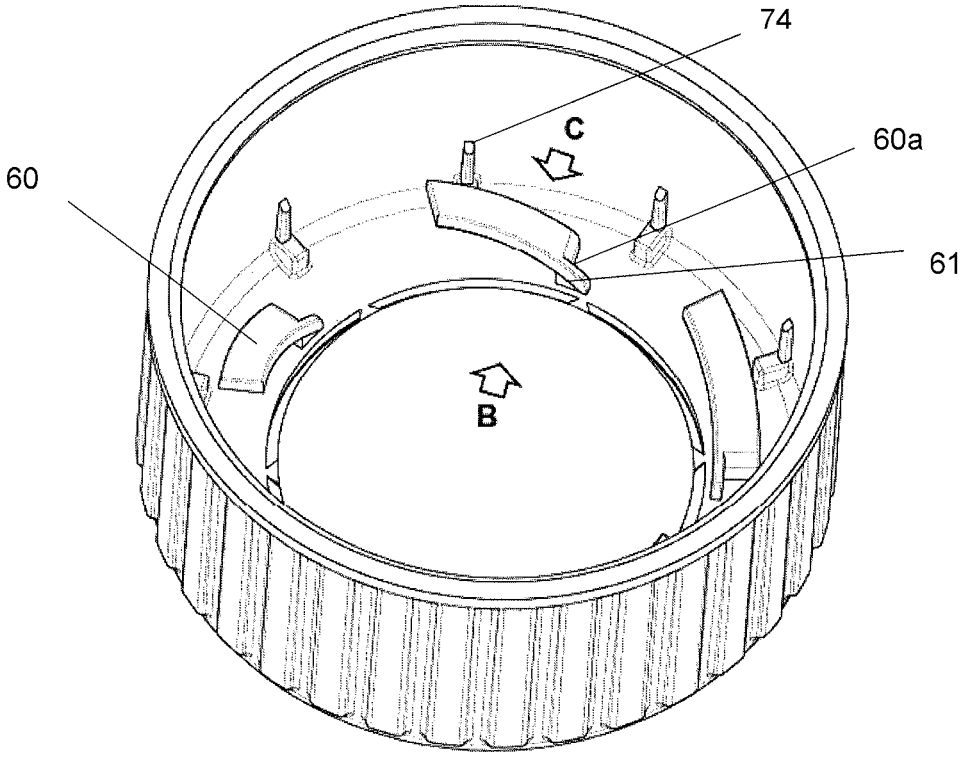
FIG. 16 is a bottom perspective view of the outer cap according to FIG. 13.
Figure 17:
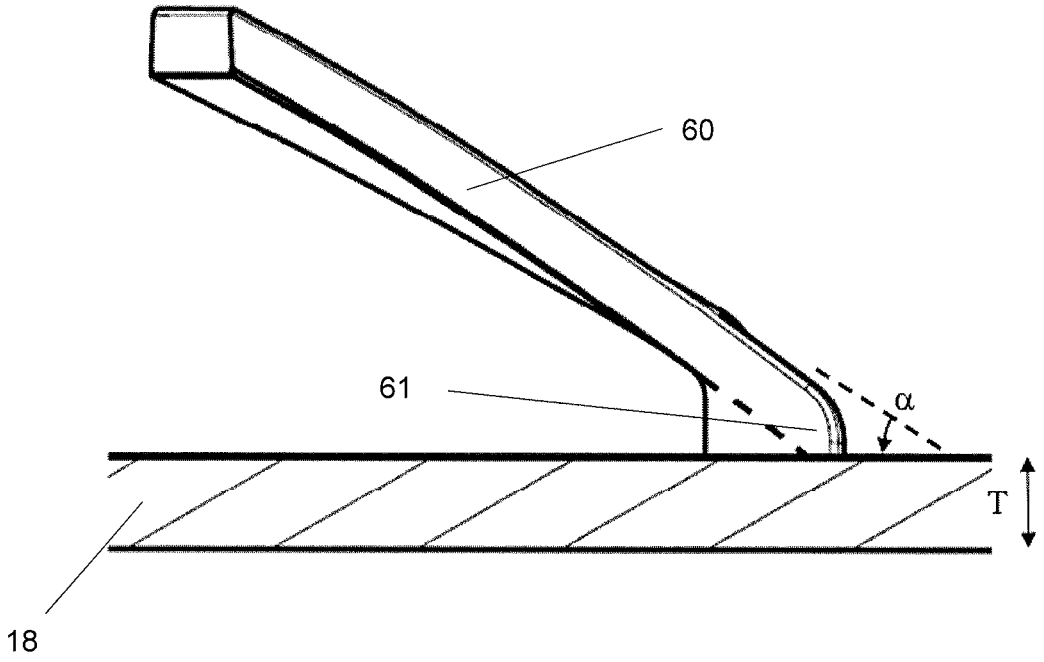
FIG. 17 is a view in the direction of arrow B in FIG. 16.
Figure 18:
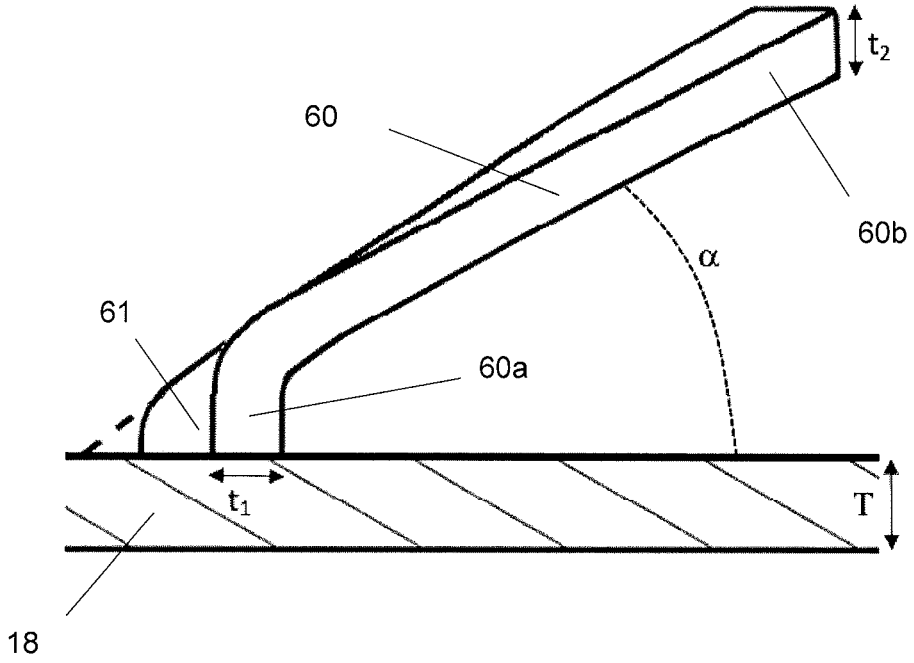
FIG. 18 is a view in the direction of arrow C in FIG. 16.
Figure 19:
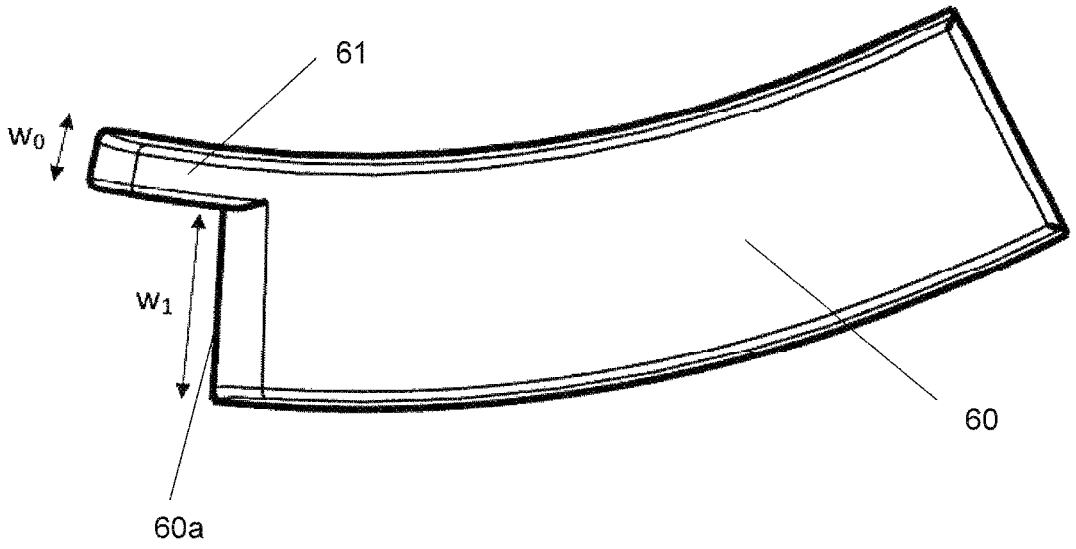
FIG. 19 shows a top view of the elastic member according to the embodiment of FIGS. 13 to 18.

FIGS. 17 and 18 are a view in the direction of arrow B in FIG. 16, and in the direction of arrow C in FIG. 16, respectively. As can be seen, the elastic member 60 generally has an angular orientation relative to the top wall 18, wherein the angle $\alpha$ is $20° < \alpha < 45°$, preferably $25° \leq \alpha \leq 40°$. Most preferably, the angle $\alpha$ is about 30°. Further, it should be noted that it is preferred that the thickness of the elastic means increases from the basis 60*a* to the free end 60*b* of the elastic member 60. At least, the thickness $t_2$ at the free end 60*b* should not be smaller than the thickness $t_1$ at the basis 60*a* of the elastic member 60. However, it is preferred that the thickness $t_2$ at the free end 60*b* is about 25% higher than the thickness $t_1$ at the basis 60*a* of the elastic member. As regards the total thicknesses, the thickness $t_1$ at the basis 60*a* of the elastic member 60 should satisfy the equation:

$$t_1 \leq \tfrac{2}{3} \times T$$

wherein T is the thickness of the top wall 18 of the outer cap. As a specific example, the wall thickness T of the top wall 18 could be 1.2 mm, the thickness $t_1$ at the basis 60*a* could be 0.8 mm and the thickness $t_2$ at the front end 60*b* could be 1.2 mm. In general, the thickness $t_2$ of the elastic member 60 at the free end 60*b* should be about 1 mm.

Further preferred dimensions follow from FIG. 19 which shows a top view of the elastic member according to the embodiment of FIGS. 13 to 18. The width $W_0$ of the reinforcing rib 61 should satisfy the equation:

$$W_0 \leq \tfrac{2}{3} \times T$$

with the thickness T of the top wall 18 of the outer cap (see FIG. 18). For example, for a thickness of the top wall T of about 1.2 mm, the width $W_0$ of the reinforcing rib 61 could be selected to be about 0.6 mm.

Finally, it was found to be advantageous to set the relative dimensions of the width $W_0$ of the reinforcing rib 61 and the width $W_1$ at the basis 60*a* of the elastic member 60 so that $W_1<W_0$.

The above-discussed preferred geometries, and especially the angular orientation of the elastic member, the increasing thickness of the elastic member from the basis 60*a* to the free end 60*b*, the preferred thickness of the elastic member 60 in relation to the thickness of the top wall, the width of the reinforcing rib, and the relationship between the width of the reinforcing rib 61 and the width at the basis 60*a* of the elastic member can be independently realized or be realized in any combinations thereof. The positions of the elastic members 60 and the wedge-shaped elements with the inclined surfaces 68' can be exchanged so that the elastic members are attached to the upper surface of the top wall 44 of the inner cap 14.

Figure 24A:
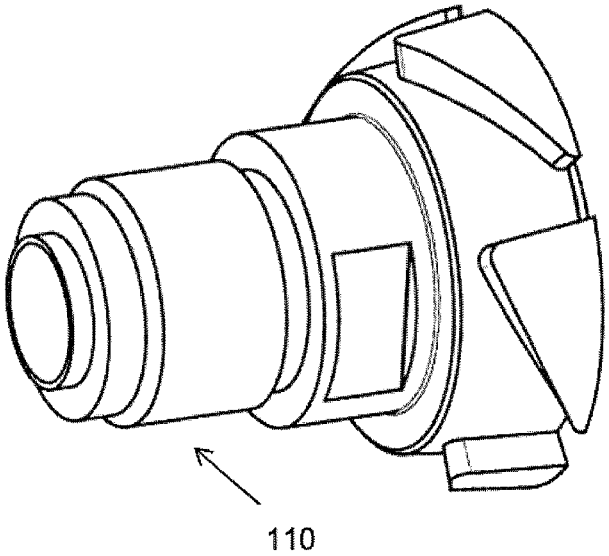
FIGS. 24*a* and 24*b* show the first part and the second part of the core of the mould, respectively.
Figure 24B:
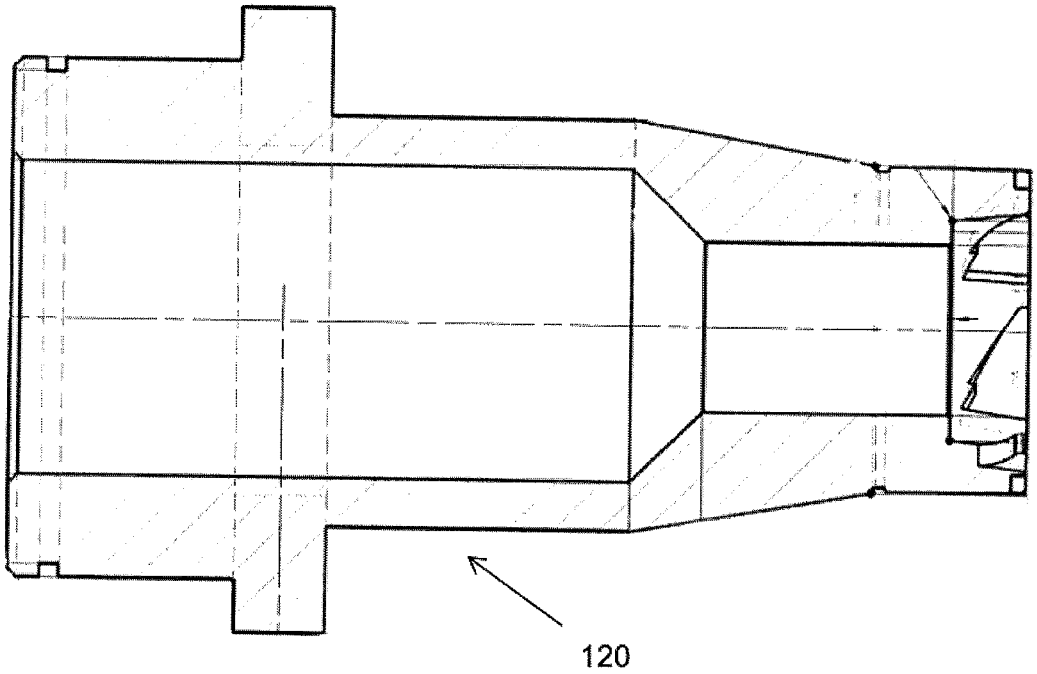
Figure 24C:
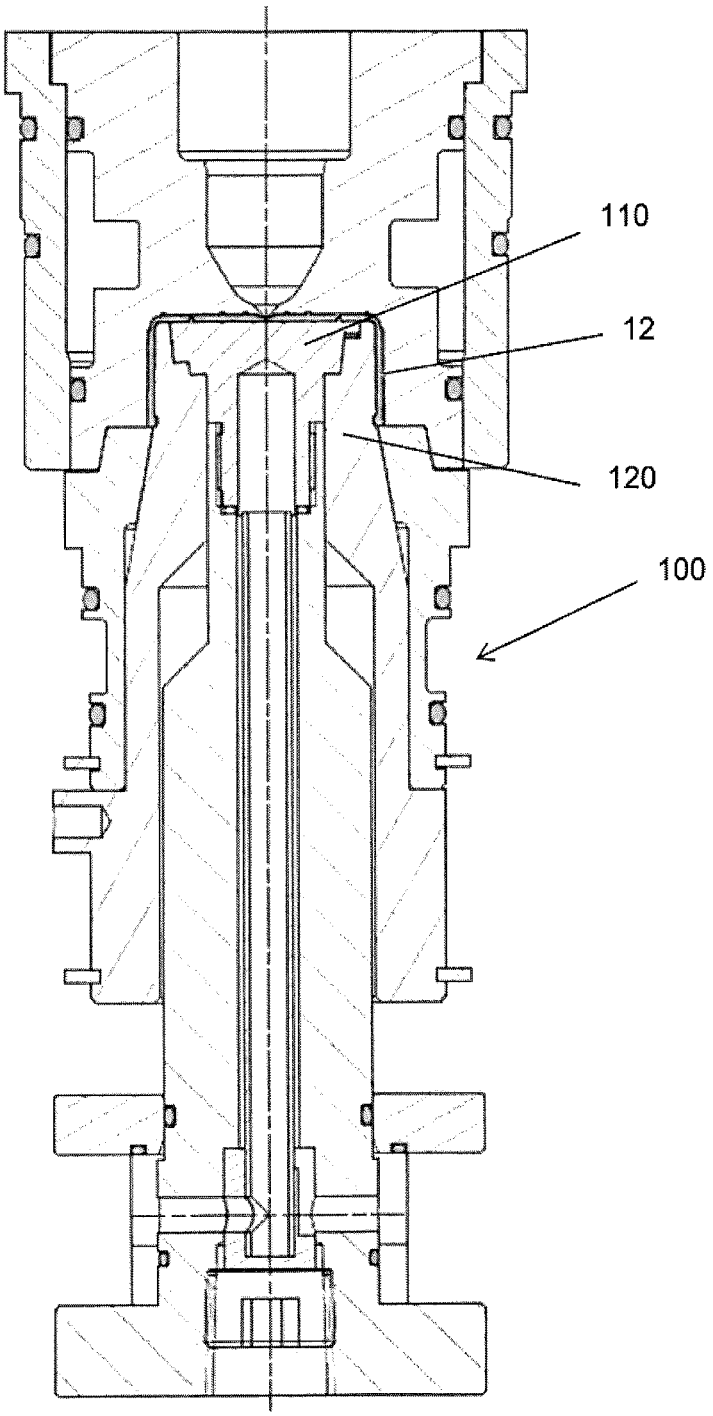
FIG. 24*c* shows the mould with the first and second part of the core and the outer cap within the mould.

No matter how the reinforcing rib 61 is shaped, the outer cap 12 with the elastic members 60 can be demolded without requiring a sliding mold. Nevertheless, due to the change of direction of the elastic members 60, which start from the top wall in a vertical direction and then run in an oblique direction, it is preferable to have a core of the mold that is in two parts for molding the internal surface of the cap. A mould 100 with a first part of the core 110 and a second part of the core 120 is shown in FIG. 24*c*, and FIGS. 24*a* and 24*b* show the first part 110 of the core and the second part 120 of the core, respectively. The first part 110 of the core of the mold 100 is on the center and includes the surface of the elastic members facing the top wall. The second part 120 of the core is an annular part which includes the cavity for the opposed surface of the elastic members. In such a way, the elastic members 60 with the curved shape as shown can be molded by first separating the outer cap 12 from the second part 120, which allows the elastic members to flex for being released from the first part 110 of the mould.

Figure 15:
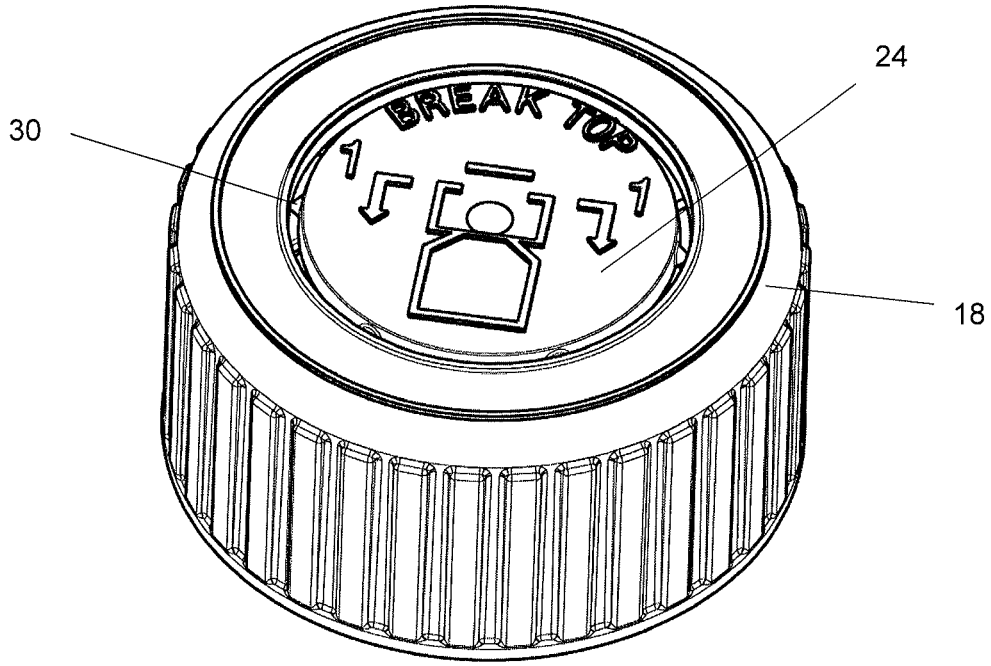
FIG. 15 is a top perspective view of the outer cap according to FIG. 13.

The outer cap as shown in FIG. 15 can represent the perspective top view both for the embodiment as shown in FIG. 16 and the embodiment as shown in FIG. 12 with their different shapes of the reinforcing ribs 61.

FIG. 20 is a cross-sectional view which shows the final assembly of the inner cap and outer cap on the neck of a container. The desiccant chamber 48 of the inner cap 14 is filled with sorbent material. The gas permeable cover 54 closes the desiccant chamber 48 and is held by the closing means 52 which are the ends of the annular sidewall 50 of the desiccant chamber and which are crimped to hold the cover 54. The inner cap 14 is nested within the outer cap 12 such that the elastic members 60 abut against the inclined surfaces 68'. The inner cap and outer cap are screwed onto the neck portion 34 of the container. The dispensing opening of the container is sealed by the contact of the neck portion 34 of the container with the sealing skirt 38' of the inner cap 14.

In operation, if a user turns the outer cap relative to the inner cap in an opening rotational direction without pushing down the outer cap, there will be an audible indication of the elastic members 60 which ride up the beveled surfaces 68' and then elastically snap down the step portions 69 of the wedge-shaped elements with the beveled surfaces 68'.

Once the outer cap 12 is sufficiently depressed relative to the inner cap 14, the tamper-evident member 24 will be removed from the outer cap by breaking the frangible means 30 between the top wall 18 of the outer cap 12 and the tamper-evident member 24. When further pushing down the outer cap 12 relative to the inner cap 14, the driving members 62 of the outer cap come into engagement with the serrations 66 of the inner cap so that the closure can be opened.

When closing the closure again, a user turns the outer cap in the opposite direction. The elastic members 60 abut against the step portions 69 of the wedge-shaped elements with the beveled surfaces 68' so that the inner cap 14 will be rotated together with the outer cap 12. No depression of the outer cap 12 relative to the inner cap 14 is required.

The elastic members 60 have the further function to bias the inner cap 14 and outer cap 12 away from each other in an axial direction so that the tamper-evident member 24 will not be broken without the specific application of a downward pushing force on the outer cap 12 during the first use of the closure.

Figure 21:
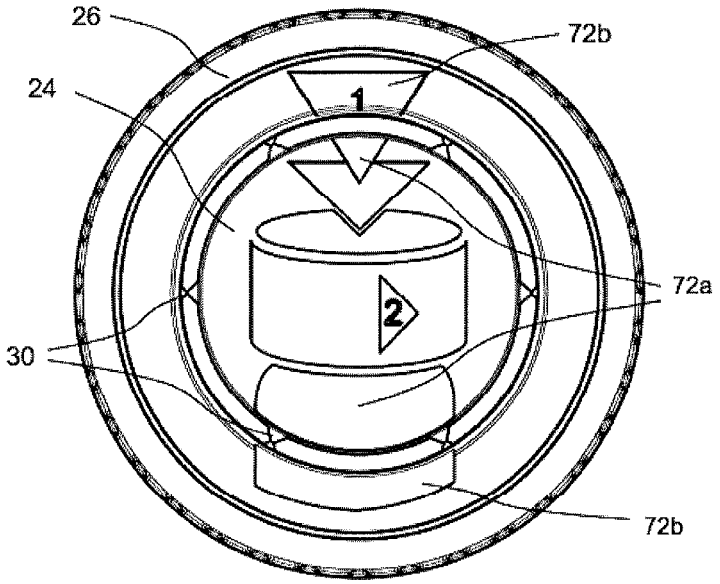
FIGS. 21 and 22 are top views of the outer cap according to further variants.
Figure 22:
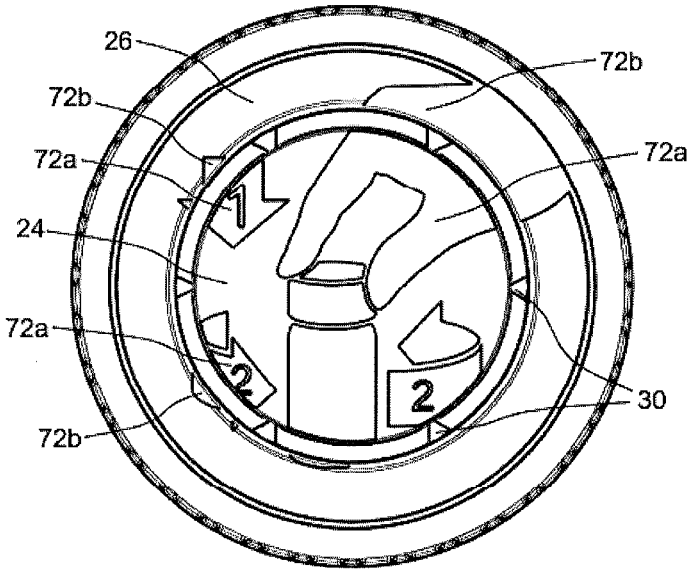

The embodiments as shown in FIGS. 21 and 22 are only examples of possible designs of the top wall 18 of the outer cap 12. The closure is provided with an indication 72 which is both on the outwardly facing surface 72*a* of the tamper-evident member 24 and the outwardly facing surface 72*b* of the surrounding region 26 which is part of the top wall 18 of the outer cap 12. The indication on the surfaces 72*a* and 72*b* supplement each other in such a way that, once the tamper-evident member 24 is no more present, it becomes evident that a part of the top wall is missing and that the closure is no more tamper proof.

FIG. 22 shows a different design of the indication 72 and distinguishes from the embodiment according to FIG. 21 by the shape of the frangible means 30. In the embodiment according to FIG. 21, the frangible means 30 will break close to the surrounding region 26 which are part of the top wall 18 of the outer cap 12, whereas the substantially triangular shape of the frangible means 30 in the embodiment of FIG. 22 will lead to a breaking of the frangible means 30 at a position where the frangible means are linked to the tamper-evident member 24. Therefore, once the tamper-evident member 24 has been removed, the frangible bridges 30 still protrude out of the surrounding region 26 so that it becomes even more visible that a part of the outer cap 12 has been removed and that the container is no more tamper proof. In order to increase the visibility, it is preferable that the remaining frangible means 30 protrude at least 0.5 mm out of the surrounding region 26 and into the opening left once the tamper-evident member 24 has been removed.

Figure 23:
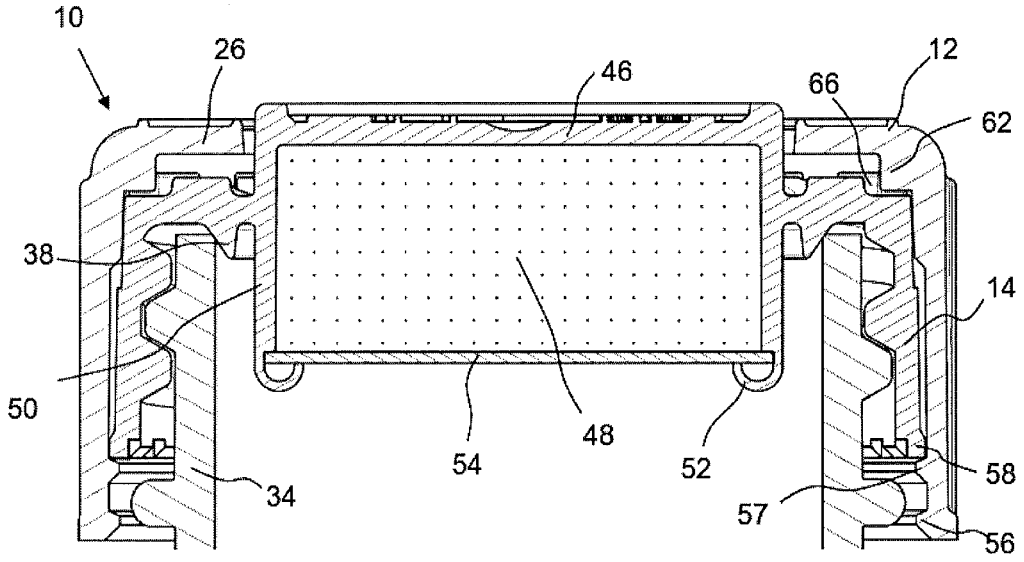
FIG. 23 shows a cross-sectional view of another embodiment of the invention.

The embodiment according to FIG. 23 shows a cross-sectional view which is similar to that as shown in FIG. 20. It shows the closure in the state in which the tamper-evident member has already been removed by pushing down the outer cap 12 in an axial direction towards the inner cap 14. In the following, the specific differences between FIG. 20 and FIG. 23 will be addressed so that no detailed explanation of the other elements is required.

FIG. 23 lacks the provision of elastic members 60 so that there is no elastic biasing force which, once the outer cap 12 has been axially pushed towards the inner cap 14, lifts up the outer cap 14 into its initial position. Instead, a blocking means 57 is provided which, in the embodiment according to FIG. 23, is a radially inwardly directed bead on the outer cap 12 which, as shown in FIG. 23, forms a form-fit connection with the inner cap 14 and fixes the relative position of the outer cap and the inner cap such that the serrations 62 and 66 remain engaged without requiring the downward pressure. The closure can be simply unscrewed without requiring a complex movement. Accordingly, there is no continued child-resistance except for the container before its first use.

Both the inner cap 14 and outer cap 12 can be manufactured by means of injection moulding from a suitable plastic material. Examples of polymers usable are polyolefin-based polymers, in particular polyethylene and especially high density polyethylene, as well as polypropylene.

The material of the closure 10 as well as the material of the corresponding container has to be selected according to the specific field of application. The same applies for the use of an active agent for either trapping or releasing a gaseous component. These materials have to be selected according to the use of the container and its closure. Because of their high safety as being childproof combined with a very clear indication which makes any tampering highly evident, the container and closure are advantageously used for storing medical compositions, like tablets or capsules.

The major advantage of the inventive closure is its high versatility. It can be used for all screw-necked bottles or containers. Without any modification to a conventional screw necked bottle or container, it is possible to combine the three functions of being child resistant, tamper-evident and providing active control of the atmosphere in the container.

The invention claimed is:

1. A tamper-evident closure for a container with an outer screw thread opening, comprising:

an outer cap with a first sidewall and a first top wall; and an inner cap with a second sidewall and a second top wall;

wherein the inner cap is coaxially nested within the outer cap and comprises an inner thread to screw the inner cap onto the container; and wherein the outer cap and inner cap comprise cooperating engagement mechanisms;

wherein the cooperating engagement mechanisms are arranged and shaped such that when opening the closure for the first time, the inner cap is rotated by the outer cap upon application on the outer cap of an axial-force plus a turning mechanical torque in a first rotational direction;

wherein a part of the first top wall comprises a tamper-evident member which is connected to a surrounding region of the first top wall by a frangible component; and wherein a protruding element is arranged at the first top wall facing the second top wall and/or the second top wall facing the first top wall so as to face the tamper-evident member;

wherein the closure further comprises an identification medium comprising an additional tamper-evident indication, and wherein the frangible component comprises frangible bridges located between the tamper-evident member and the surrounding region of the first top wall, wherein the frangible bridges include a reduced thickness section between the tamper-evident member and the surrounding region of the first top wall, wherein the frangible bridges comprise either triangular frangible bridges or frangible bridges having a decreasing cross section followed by an increasing cross section between the surrounding region and the tamper-evident member, and wherein, once the tamper-evident member has been removed, the frangible bridges protrude at least 0.5 mm out of the surrounding region of the first top wall.

2. The tamper-evident closure according to claim 1, wherein the identification medium comprises the frangible component which break such that a part of it remains connected to the first top wall and can be seen.

3. The tamper-evident closure according to claim 1, wherein the identification medium comprises indications provided on the top wall of the tamper-evident member and the surrounding region of the first top wall which supplement each other before the first opening and no longer supplement each other once the tamper-evident member has been removed.

4. The tamper-evident closure according to claim 1, wherein the protruding element breaks the frangible component upon application of the axial-force on the outer cap.

5. The tamper-evident closure according to claim 1, wherein the first sidewall and the second sidewall comprise cooperating locking elements to prevent a removal of the outer cap from the inner cap once assembled, wherein the cooperating locking elements comprise a continuous or discontinuous bead on an inner side of the first sidewall of the outer cap and a continuous or discontinuous rib or flange on an outer side of the second sidewall of the inner cap.

6. The tamper-evident closure according to claim 1, wherein the protruding element is arranged at the second top wall facing the first top wall for breaking the frangible component and the protruding element is at least partially of a different color than the first top wall.

7. The tamper-evident closure according to claim 1, wherein the outer cap is made of a transparent material.

8. A container with the tamper-evident closure according to claim 1, wherein the tamper-evident closure is fixedly screwed onto an outer screw thread of the container.

* * * * *